US009682582B2

(12) United States Patent
Nakata et al.

(10) Patent No.: US 9,682,582 B2
(45) Date of Patent: Jun. 20, 2017

(54) RECORDING APPARATUS

(71) Applicant: SEIKO EPSON CORPORATION, Tokyo (JP)

(72) Inventors: Masanori Nakata, Matsumoto (JP); Yuichi Segawa, Shiojiri (JP); Satoshi Chiba, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/053,466

(22) Filed: Feb. 25, 2016

(65) Prior Publication Data

US 2016/0279970 A1 Sep. 29, 2016

(30) Foreign Application Priority Data

Mar. 27, 2015 (JP) ..... 2015-066982

(51) Int. Cl.

| | |
|---|---|
| ***B41J 29/17*** | (2006.01) |
| ***B41J 13/02*** | (2006.01) |
| ***B41J 11/00*** | (2006.01) |

(52) U.S. Cl.

CPC ..... *B41J 29/17* (2013.01); *B41J 11/006* (2013.01); *B41J 11/007* (2013.01); *B41J 11/0085* (2013.01); *B41J 13/025* (2013.01)

(58) Field of Classification Search

CPC ..... B41J 29/17; B41J 11/0085; B41J 11/007
See application file for complete search history.

(56) References Cited

U.S. PATENT DOCUMENTS

| | | | | |
|---|---|---|---|---|
| 5,274,399 | A | 12/1993 | Uchida et al. | |
| 5,526,028 | A * | 6/1996 | Rottman | B41J 11/007 347/102 |
| 5,999,790 | A * | 12/1999 | Folkins | G03G 15/0152 399/345 |
| 6,679,601 | B1 * | 1/2004 | Pham | B41J 29/17 134/6 |
| 2006/0192804 | A1 * | 8/2006 | Nakata | B41J 11/003 347/16 |
| 2007/0103503 | A1 * | 5/2007 | Matsuhashi | B41J 2/16508 347/29 |

(Continued)

FOREIGN PATENT DOCUMENTS

| | | | |
|---|---|---|---|
| JP | 2816217 | B | 8/1998 |
| JP | 2003-011377 | A | 1/2003 |

(Continued)

*Primary Examiner* — Shelby Fidler
(74) *Attorney, Agent, or Firm* — Workman Nydegger

(57) ABSTRACT

A recording apparatus includes a recording section which performs recording by discharging ink on paper, a transport belt which is able to transport the paper by rotating, a charging roller which charges the transport belt, a cleaning unit which moves the charging roller between a contact position that is a position at which the charging roller is brought into contact with the transport belt and a separation position which is a position that is separated from the transport belt more than the contact position, and a dirt estimation section which estimates dirt on the transport belt, in which the cleaning unit moves the charging roller from the contact position to the separation position in a case where the dirt estimation section estimates that the transport belt is dirty.

6 Claims, 14 Drawing Sheets

(56) References Cited

U.S. PATENT DOCUMENTS

| | | | | |
|---|---|---|---|---|
| 2008/0050135 | A1* | 2/2008 | Kawabata | G03G 15/6529 399/50 |
| 2009/0179928 | A1 | 7/2009 | Nemoto et al. | |
| 2009/0200735 | A1* | 8/2009 | Yamamoto | B65H 5/02 271/264 |
| 2011/0316913 | A1* | 12/2011 | Kaiho | B41J 29/38 347/9 |
| 2012/0069078 | A1* | 3/2012 | Kaneko | B41J 13/223 347/16 |
| 2012/0300004 | A1* | 11/2012 | Takano | B41J 11/007 347/104 |
| 2013/0321509 | A1* | 12/2013 | Sakano | B41J 2/16535 347/16 |

FOREIGN PATENT DOCUMENTS

| | | | |
|---|---|---|---|
| JP | 2009-166338 | A | 7/2009 |
| JP | 2012-051282 | A | 3/2012 |

* cited by examiner

RECORDING APPARATUS

BACKGROUND

1. Technical Field

The present invention relates to a recording apparatus which is provided with a transport belt which transports a recording medium.

2. Related Art

In the related art, an ink jet type printer is known as one type of recording apparatus, which is provided with a recording section that performs recording on paper which is an example of a recording medium, and performs recording (printing) of an image or the like on paper by discharging ink as a liquid (recording liquid) from the recording section with respect to the paper which is transported by an endless transport belt that rotates by being stretched on a roller.

In such a printer, a configuration is often adopted in which a belt surface of the transport belt is charged with static electricity using a charging roller which comes into contact with the transport belt, and the paper is transported by being adsorbed to the belt surface due to an action of a static electricity with which the transport belt is charged.

In the related art, a structure is proposed in which, in a case of a jam state in which transport using the transport belt of the paper is delayed, the transport belt moves such that a jam process is able to be performed in the printer which transports the paper using such a transport belt. That is, the transport belt is configured so as to be moved from a position (first position) at which the paper (recording medium) is transported toward the recording section (recording head) to a position (second position) which is separated from the recording section when a jam occurs (for example, refer to JP-A-2012-51282).

However, in the related art, in a case where the paper is in a jam state, it is possible that ink which is discharged from a recording section adheres to a belt surface of a transport belt and not paper. For this reason, for example, the belt surface of the transport belt becomes dirty due to the adhered ink or the like. When the transport belt rotates during cleaning of the dirty belt surface, performance of a charging roller, which comes into contact with the belt surface of the transport belt, that charges the belt surface is reduced due to dirt on the belt surface, and the charging roller becomes dirty by the dirt on the belt surface moving to a roller surface. As a result, it becomes difficult for the charging roller to stably charge the transport belt due to the dirt on the roller surface, and thus there is a problem in that time or work becomes necessary in order to remove the dirt.

Here, such circumstances are generally common in recording apparatuses each of which is provided with a recording section that performs recording on a recording medium, a transport belt which is able to transport the recording medium by rotating, and a charging roller which charges the transport belt.

SUMMARY

An advantage of some aspects of the invention is to provide a recording apparatus which is able to suppress dirt on a charging roller.

Hereinafter, means of the invention and operation effects thereof will be described.

A recording apparatus includes a recording section which performs recording by discharging liquid on a recording medium, a transport belt which is able to transport the recording medium by rotating, a charging roller which charges the transport belt, a charging roller moving section which moves the charging roller between a charging roller contact position that is a position at which the charging roller is brought into contact with the transport belt and a charging roller separation position which is a position that is separated from the transport belt more than the charging roller contact position, and a dirt estimation section which estimates dirt on the transport belt, in which the charging roller moving section moves the charging roller from the charging roller contact position to the charging roller separation position in a case where the dirt estimation section estimates that the transport belt is dirty.

According to this configuration, in a case where it is estimated that the transport belt is dirty, the charging roller is separated from the transport belt and thus it is possible to suppress dirt accompanying contact between the transport belt and the charging roller.

In the recording apparatus, it is preferable that the dirt estimation section estimates that the transport belt is dirty when detecting a jam state in which transport of the recording medium by the transport belt is delayed.

According to this configuration, it is possible to suppress dirt of the charging roller by detecting the jam state of the recording medium in a case where a probability is high that the transport belt is made dirty by a liquid due to the recording section performing recording by, for example, discharging liquid, in the jam state in which transport of the recording medium is delayed.

In the recording apparatus, it is preferable that the transport belt is stretched between a driving roller and a driven roller, and the recording apparatus further includes a belt moving section which moves the transport belt to a second position that is further separated from the recording section than a first position at which the recording section performs recording by swinging the transport belt about a roller shaft of the driving roller in a case where the dirt estimation section estimates that the transport belt is dirty.

According to this configuration, a dirt condition of the transport belt is suppressed by keeping the transport belt away from the recording section. Accordingly, even if the charging roller comes in contact again with the transport belt on which the dirt condition is suppressed, the dirt is suppressed.

It is preferable that the recording apparatus further includes a cap which is able to cover at least a portion of the recording section from which the liquid is discharged, using a closed space, in which the charging roller is positioned at the charging roller contact position at which the charging roller comes into contact with the transport belt in a case where the liquid is discharged toward the cap from the recording section.

According to this configuration, for example, it is possible to shorten time until the recording medium is transported again by the transport belt by maintaining the charging roller at the contact position in a case where a probability is low that the transport belt is made dirty by the liquid which is discharged from the recording section.

BRIEF DESCRIPTION OF THE DRAWINGS

The invention will be described with reference to the accompanying drawings, wherein like numbers reference like elements.

DESCRIPTION OF EXEMPLARY EMBODIMENTS

As a first embodiment of a recording apparatus, an ink jet type printer which is provided with a recording section that discharges ink that is an example of liquid, and performs printing (recording) of an image which includes characters, graphics, and the like by discharging ink onto paper which is an example of a recording medium is described below with reference to the drawings.

Figure 1:
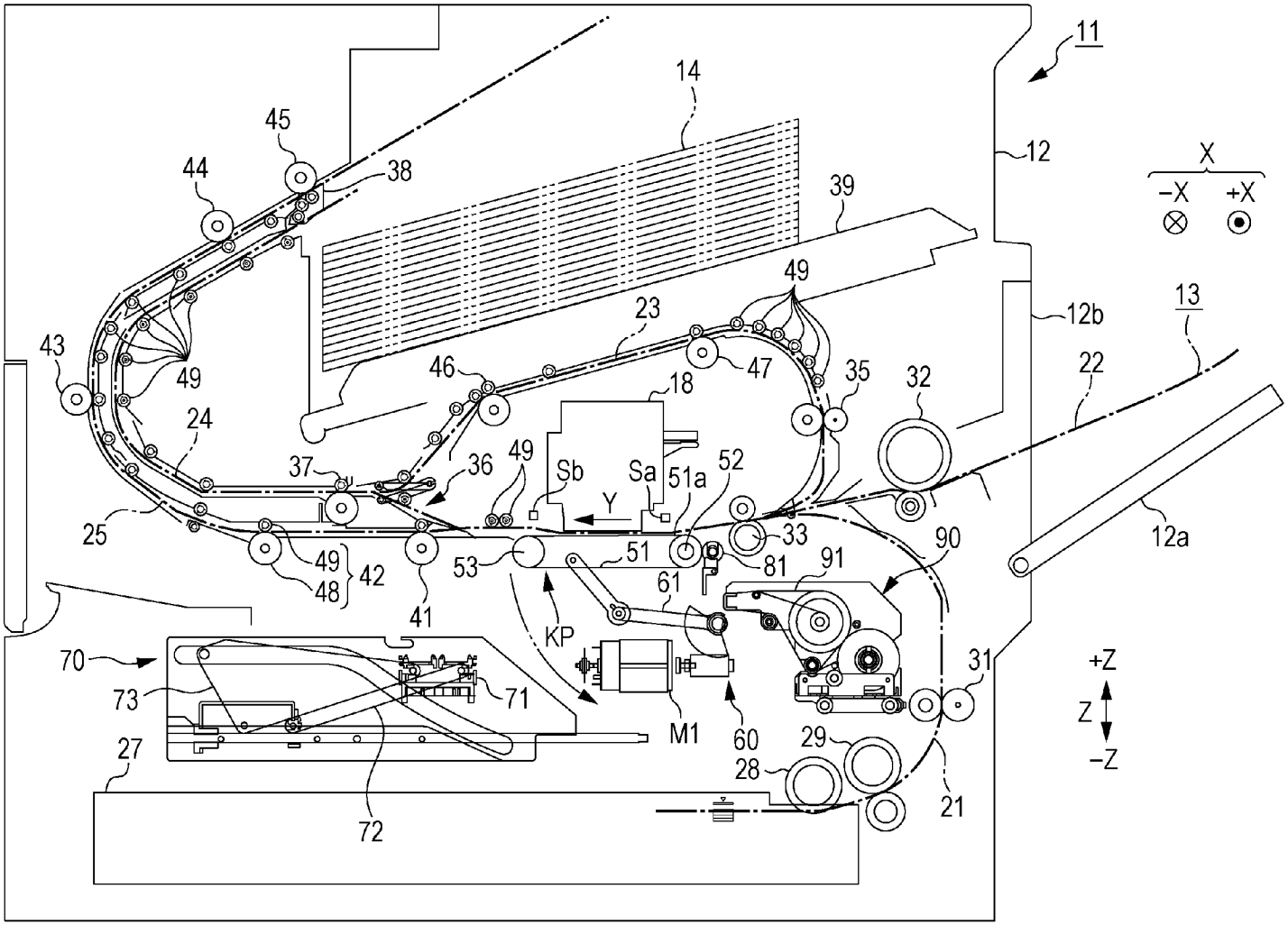
FIG. 1 is a schematic configuration diagram illustrating an embodiment of a printer which is an example of a recording apparatus.

As shown in FIG. 1, a printer 11 as an example of the recording apparatus of the embodiment has a casing 12 which is a rectangular body made from a plurality of outer cases and the like as an apparatus body, and a transport path 13 which transports paper 14, as indicated by a thick dashed line in FIG. 1, is provided in the casing 12. Then, a plurality of pairs of rollers which transport the paper 14 along the transport path 13, a transport belt 51 which transports the paper 14 while supporting from a gravity direction −Z side (lower side) in a vertical direction Z, and a recording section 18 which discharges ink with respect to the transported paper 14 are mounted in the casing 12. The transport belt 51 is mounted in the casing 12 in a state of being movable to a first position facing the recording section 18 by interposing the transport path 13, that is, a usable state using a belt moving section 60 (refer to FIGS. 4 and 6).

In the embodiment, the recording section 18 is a so-called line head in which a width direction X that intersects with (here is orthogonal to) a transport direction Y of the paper 14 is set as a longitudinal direction, and has a liquid discharge head which is able to simultaneously discharge ink across the longitudinal direction. Here, for ease of explanation hereinafter, in the width direction X, a left direction (direction facing a front surface side of a paper surface) viewed from an upstream side of the transport direction Y is set as a +X direction, and a right direction (direction facing a rear surface side of the paper surface) viewed from the upstream side of the transport direction Y is set as a −X direction.

The recording section 18 which is a line head performs printing as recording by discharging ink from an anti-gravity direction +Z side (upper side) toward the paper 14 which is transported in the state of being supported on the transport belt 51. Here, the position of the transport belt 51 when printing is performed on the paper 14 using the recording section 18, that is, the first position at which the transport belt 51 faces the recording section 18 is referred to as a recording position KP.

The transport path 13 is configured by a first supply path 21 and second supply path 22 more on the transport direction Y upstream side than the recording section 18, and a third supply path 23, a branching path 24, and a discharge path 25 more on the transport direction Y downstream side than the recording section 18.

The first supply path 21 is a path which links the recording section 18 and a paper cassette 27 which is removably provided in a bottom section that is on the gravity direction −Z side of the casing 12. Then, out of the paper 14 which is mounted in a laminated state in the paper cassette 27, a pick-up roller 28 which delivers the paper 14 of a highest layer, and a separation roller 29 which separates the paper 14 one sheet at a time which is delivered by the pick-up roller 28 are provided on the first supply path 21. Furthermore, a first supply roller pair 31 is provided more on the transport direction Y downstream side than the separation roller 29.

The second supply path 22 is a path which links the recording section 18 and an insertion section 12*b* which is exposed by opening a cover 12*a* that is provided on one side surface of the casing 12. Then, a second supply roller pair 32 which supports and transports the paper 14 that is inserted from the insertion section 12*b* is provided on the second supply path 22. Furthermore, a third supply roller 33 is provided at a position at which the first supply path 21, the second supply path 22, and the third supply path 23 converge, and a fifth supply roller pair 35 is provided on the third supply path 23.

The third supply path 23 is a path which is provided so as to surround the recording section 18, and is a path for returning the paper 14 again which passes once through the recording section 18 more to the upstream side than the recording section 18. That is, a branching mechanism 36 is provided more on the downstream side than the recording section 18, and a branching roller pair 37, which is able to rotate both forward and reverse, is provided on the branching path 24 which branches from the discharge path 25.

The discharge path 25 is a path which links the recording section 18 and a discharge port 38 through which the printed paper 14 is discharged. Here, the paper 14 which is discharged from the discharge port 38 is mounted onto a mounting base 39. Then, at least one transport roller pair (a first transport roller pair 41 to a fifth transport roller pair 45 in the embodiment) is provided on the discharge path 25. Furthermore, a sixth transport roller pair 46 and a seventh transport roller pair 47 are also provided on the third supply path 23. The first transport roller pair 41 to the seventh transport roller pair 47 support and transport the paper 14 on which ink is adhered.

That is, the first transport roller pair 41 to the seventh transport roller pair 47 are respectively configured by a cylindrical driving roller 48 which rotates based on driving force of a driving source, and a toothed roller 49 which is driven to rotate accompanying the rotation of the driving roller 48. In addition, the toothed roller 49 is also provided alone without being paired with the driving roller 48. That is, the toothed roller 49 is provided on a side through which a printing surface of the paper 14 on which printing is executed (that is, a surface on which ink that is an example of the liquid is adhered by being discharged) passes on the third supply path 23, the branching path 24, and the discharge path 25. In addition, the toothed roller 49 is also provided between each transport roller pair of the first transport roller pair 41 to the seventh transport roller pair 47 in the transport direction, and also provided between each transport roller pair and the recording section 18. Meanwhile, the driving roller 48 is provided on a side through which a non-printing surface (non-recording surface) of the paper 14 on which printing is not executed, or a surface of the paper 14, which is printed on both surfaces, that has already been printed passes.

In the embodiment, the transport belt 51 at the recording position KP that faces the recording section 18 is configured to transport the paper 14 by rotating in a state in which the paper 14 is supported by being electrostatically adhered to a belt surface 51*a* which is an outer peripheral surface of the transport belt 51. That is, the transport belt 51 is an endless belt which is stretched between two rollers, one roller out of the two rollers is set as a driving roller 52 which is rotatably driven by the driving source, and the other roller is set as a driven roller 53 which is rotated accompanying rotation of the belt. In addition, a charging roller 81 is configured by a rubber layer on a front surface of a metal roller shaft 81*a*, and is configured to apply high pressure to an end section of the roller shaft 81*a* by directly coming into contact with a leaf spring which is not shown in the drawings. Alternatively, the charging roller 81 may be configured such that a bearing section 82*a* which receives the roller shaft 81*a* of the charging roller 81 is a conductive bearing (a conductive resin, a sintered bearing, or the like), and to apply high pressure via the conductive bearing. Then, the transport belt 51 rotates accompanying rotation of the driving roller 52, and during the rotation, static electricity is charged to the transport belt 51 by the charging roller 81 which comes into contact with the belt surface 51*a*. Due to the charged static electricity, the transport belt adsorbs the paper 14 on the flat belt surface 51*a*, on the anti-gravity direction +Z side, that is formed between the driving roller 52 and the driven roller 53, and transports the adsorbed paper 14 in the transport direction Y while facing the recording section 18.

In addition, in the embodiment, with respect to the recording section 18, a first sensor Sa which detects the paper 14 on the transport direction Y upstream side, and a second sensor Sb which detects the paper 14 on the transport direction Y downstream side are disposed. The first sensor Sa and the second sensor Sb are sensors (for example, optical sensors) in an "ON" state in which a predetermined signal is output when the paper 14 is detected, and in a case where the paper 14 is transported by the transport belt 51 without delay, the second sensor Sb is turned "ON" a predetermined time after the first sensor Sa is turned "ON".

In the embodiment, in the printer 11, the transport belt 51 is provided with the belt moving section 60 which is moved from the recording position KP at which printing is performed by the recording section 18 to the second position which is separated from the recording section 18 more than the recording position KP. That is, the belt moving section 60 has a linking member 61 which operates accompanying rotational driving of the first motor M1 as the driving source. The linking member 61 operates accompanying the driving of the first motor M1, and as indicated by the chain double-dashed line arrow in FIG. 1, the transport belt 51 is moved from the recording position KP which is the first position to the second position which is separated more from the recording section 18 than the recording position KP by swinging the driven roller 53 side in the gravity direction −Z about the driving roller 52.

Figure 2:
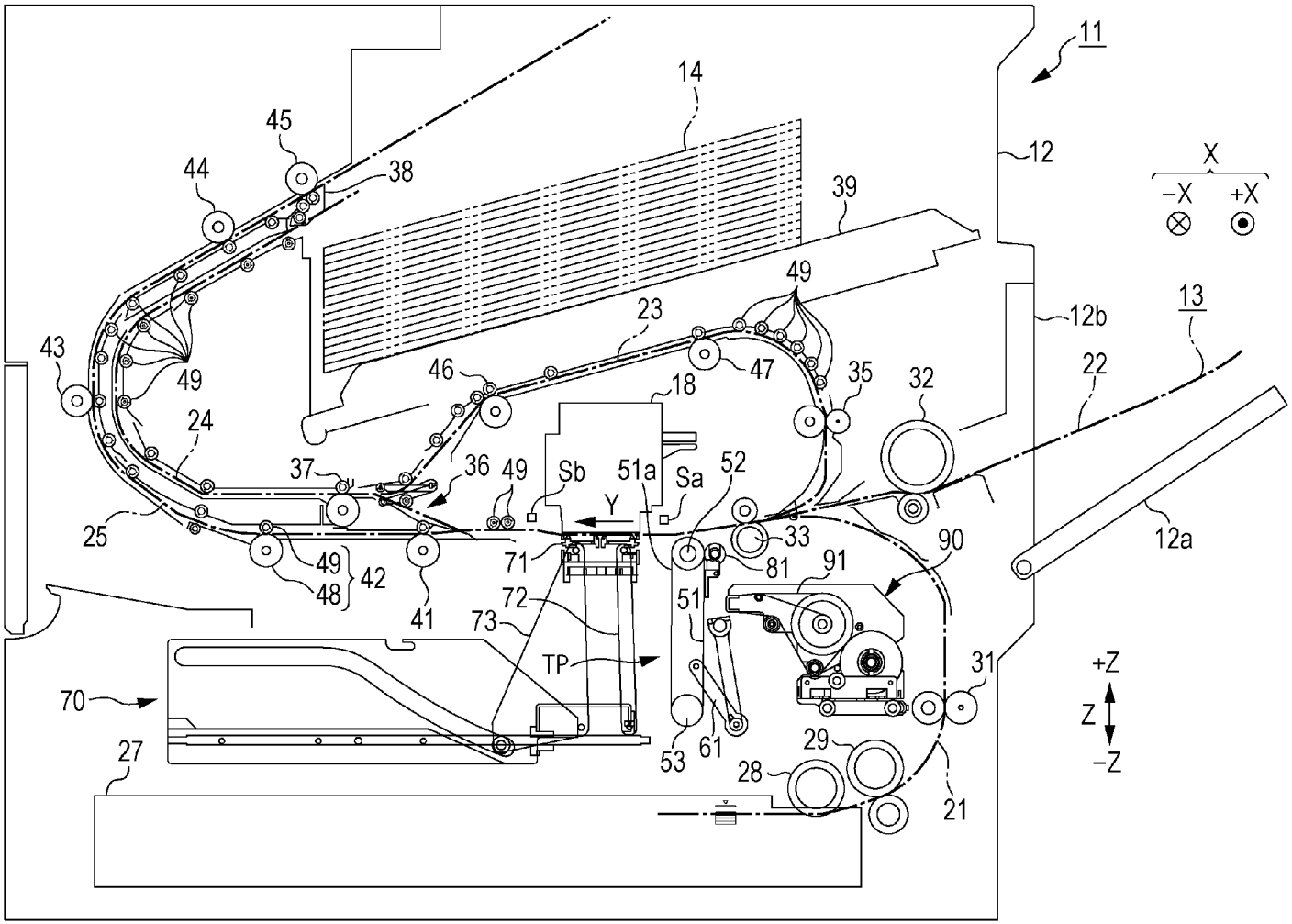
FIG. 2 is a schematic configuration diagram illustrating a state in which a transport belt is separated from a recording section, and a cap is in contact with the recording section.

As shown in FIG. 2, in the embodiment, a position at which the transport belt 51 is rotated (swung) approximately 90 degrees from the recording position KP about the driving roller 52 is set as the second position, and the second position is referred to as a retreat position TP. Then, in the embodiment, the belt surface 51*a* of the transport belt 51 has a horizontal attitude which is a substantially horizontal plane at the recording position KP, and has a vertical attitude which is a substantially vertical plane along the vertical direction Z at the retreat position TP.

Here, the state in which the transport belt 51 is in the retreat position TP is a state in which printing is not performed on the paper 14 by the recording section 18. Therefore, in the printer 11, for example, printing performance (for example, printing quality) of the recording section 18 is to be maintained by suppressing drying of ink within the recording section 18, and as shown in FIG. 2, a cap movement mechanism 70 which covers the recording section 18 is provided to come into contact with a cap 71 from the gravity direction −Z side with respect to the recording section 18 which is in a state of not performing printing.

The cap movement mechanism 70 has a structure in which a member 72 and a member 73, which hold the cap 71 that is able to cover a portion which discharges at least ink in the recording section 18 using the open space, move (move up and down) the cap 71 along the vertical direction Z using a linking mechanism and a cam mechanism when reciprocally moving along the transport direction Y. Then, as shown in FIG. 1, in a state of being separated from the recording section 18 and not covering the recording section 18, the members which configure the cap 71 and the cap movement mechanism 70 (for example, the member 72 and the member 73) are disposed at a position which does not come into contact with the transport belt 51 that is moved (swung) between the recording position KP and the retreat position TP as indicated by a chain double-dashed line arrow in FIG. 1. In other words, the transport belt 51 is provided in the printer 11 so as not to come into contact with the cap 71 and the cap movement mechanism 70 in the state of not covering the recording section 18 in the movement between the recording position KP and the retreat position TP.

In addition, as shown in FIGS. 1 and 2, in the embodiment, a cleaning unit 90 which has a cleaning member 91 that removes dirt from the transport belt 51 is provided in the printer 11. That is, the cleaning unit 90 is set to be able to reciprocally move along the transport direction Y accompanying the rotational movement of the motor as the driving source which is not shown in the drawings, and cleans dirt such as ink away which adheres to the belt surface 51*a* by wiping such that the cleaning member 91 comes into contact with the belt surface 51*a* of the transport belt 51 due to the movement in the transport direction Y. The cleaning unit 90 will be described below with reference to FIG. 9.

Figure 3:
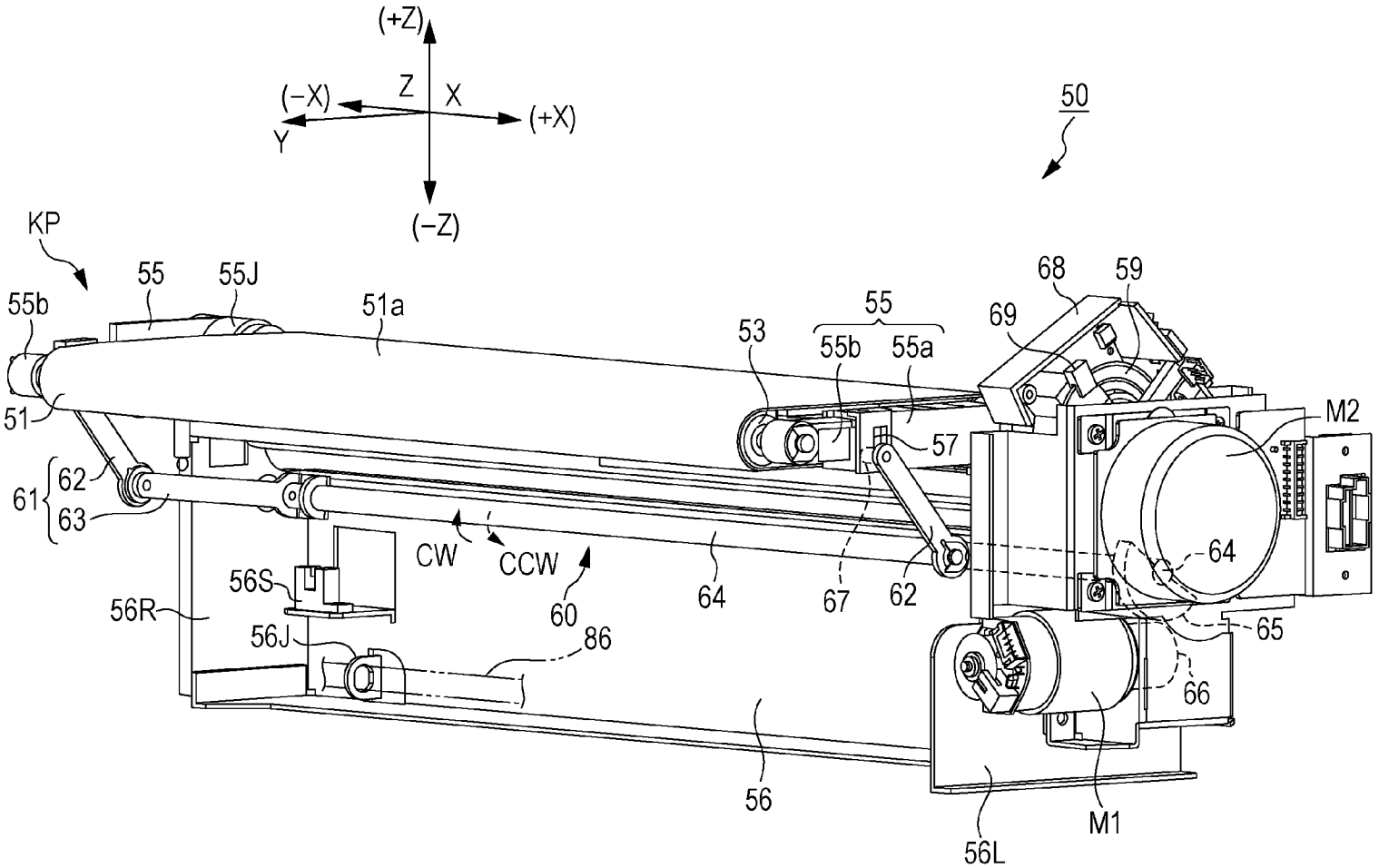
FIG. 3 is a perspective view illustrating a transport unit in which the transport belt is moved to a first position at which recording is performed by the recording section.
Figure 4:
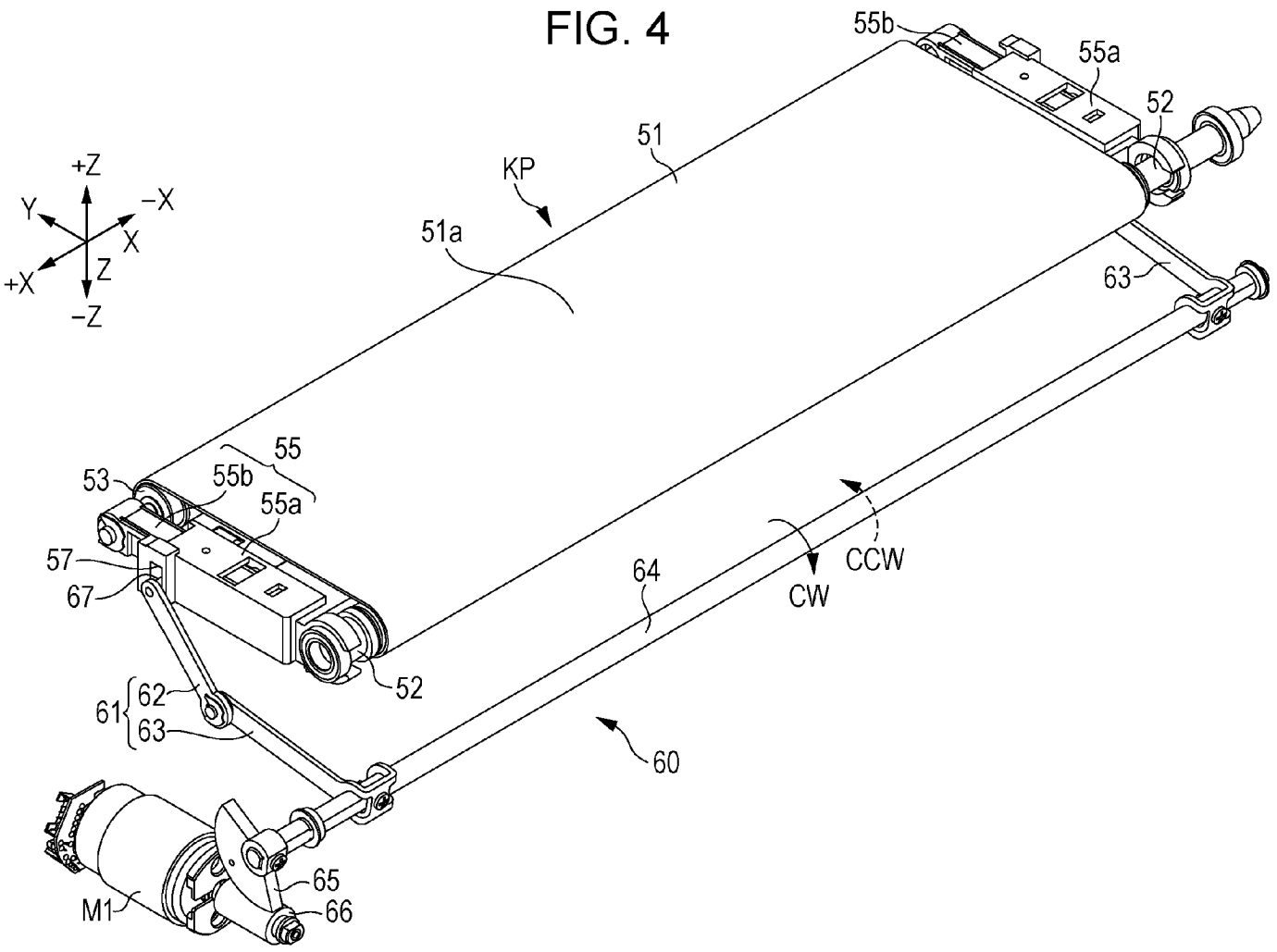
FIG. 4 is a perspective view illustrating a belt moving section in a state in which the transport belt is moved to the first position.

As shown in FIGS. 3 and 4, in the embodiment, the transport belt 51 and the belt moving section 60 are configuring members of a transport unit 50 which is one unit that includes the first motor M1. Here, in FIGS. 3 and 4, in the same manner as in FIG. 1, a state is exemplified in which the transport belt 51 on which the belt surface 51*a* is a substantially horizontal plane is at the recording position KP. In addition, in FIG. 4, configuring members are exemplified according to the belt moving section 60 which moves the transport belt 51.

The transport unit 50 has a longitudinal direction in the width direction X in the same manner as the recording section 18, and a side plate section 56R on the side section on the right side (−X direction side) in the longitudinal direction and a side plate section 56L on the side section (+X direction side) in the longitudinal direction have unit frames 56 which are respectively provided. The transport belt 51 and the belt moving section 60, and furthermore a tension adjustment section 85 (refer to FIGS. 7 and 8) which adjusts by changing tension applied to the transport belt 51 are assembled in the unit frames 56. Here, in FIG. 3, the chain double-dashed line exemplifies a portion of a cam shaft 86 which is a member that configures the tension adjustment section 85, and is axially supported so as to freely rotate about the bearing 56J which is provided in the unit frame 56. The tension adjustment section 85 is described below with reference to FIGS. 7 and 8.

In the transport unit 50, the transport belt 51 is moved to the recording position KP by the belt moving section 60 as shown in FIGS. 3 and 4. That is, a worm gear 65 is fixed to one end of the transport unit 50 accompanying the rotation of the worm gear 65 which engages with a worm 66 that is fixed to the motor shaft of the first motor M1, and a rotary shaft 64 rotates which respectively axially supports both ends of the transport unit 50 on the side plate sections 56R and 56L of the unit frame 56. In the rotary shaft 64, at two locations which are separated in the longitudinal direction (width direction X) of the rotary shaft 64 respectively, one end of a first linking plate 63 is fixedly attached, and one end of a second linking plate 62 is attached to the other end of the first linking plate 63 so as to freely rotate. The first linking plate 63 and the second linking plate 62 which are attached in this manner configure the linking member 61.

The driving roller 52 which rotates the transport belt 51 and the driven roller 53 are rotatably axially supported on a belt frame body 55 in both side end sections in the belt width direction (here, the X direction) of the transport belt 51 by respective roller shaft ends. In the belt frame body 55, when the portion which rotatably supports the roller shaft end of the driving roller 52 is set as a base section 55*a*, the portion which rotatably supports the roller shaft end of the driven roller 53 is set as an expansion and contraction section 55*b* which expands and contracts in a direction in which an axial center of the driving roller 52 and an axial center of the driven roller 53 are linked with respect to the base section 55*a*. Then, in the embodiment, the expansion and contraction section 55*b* is biased in a direction of protrusion from the base section 55*a* by a biasing member which is not shown in the drawings that is provided in the belt frame body 55. As a result, there is a configuration such that the driven roller 53 which is supported in the expansion and contraction section 55*b* is biased such that a distance to the driving roller 52 is lengthened, and a predetermined tension is applied with respect to the transport belt 51 which bridges the driving roller 52 and the driven roller 53. In this manner, the transport belt 51 stretches between the driving roller 52 and the driven roller 53.

In addition, in the belt frame body 55, a concave section 57 which is set as a substantially rectangular groove is formed in the base section 55*a*. Meanwhile, a substantially cylindrical pin 67 is attached to the other end of the second linking plate 62, and the pin 67 is set in a state of being engaged by entering the concave section 57 of the belt frame body 55. Accordingly, as indicated by a solid line arrow CW in FIGS. 3 and 4, the rotary shaft 64 rotates in a clockwise direction viewed from the +X axis direction side due to the driving of the first motor M1, and the pin 67 which is attached to the second linking plate 62 moves (swings) the belt frame body 55 due to the first linking plate 63 and the second linking plate 62 moving accompanying rotation of the rotary shaft 64. In this manner, the belt moving section 60 moves the transport belt 51 to the recording position KP by moving the belt frame body 55. Here, the first motor M1 which operates the belt moving section 60 is attached to the side plate section 56L on the left direction (+X direction) side of the unit frame 56.

In addition, as indicated by a broken line arrow CCW in FIGS. 3 and 4, the rotary shaft 64 rotates in a counterclockwise direction viewed from the +X axis direction due to the driving of the first motor M1, and the pin 67 which is attached to the second linking plate 62 moves the belt frame body 55 due to the first linking plate 63 and the second linking plate 62 moving accompanying rotation of the rotary shaft 64.

Figure 5:
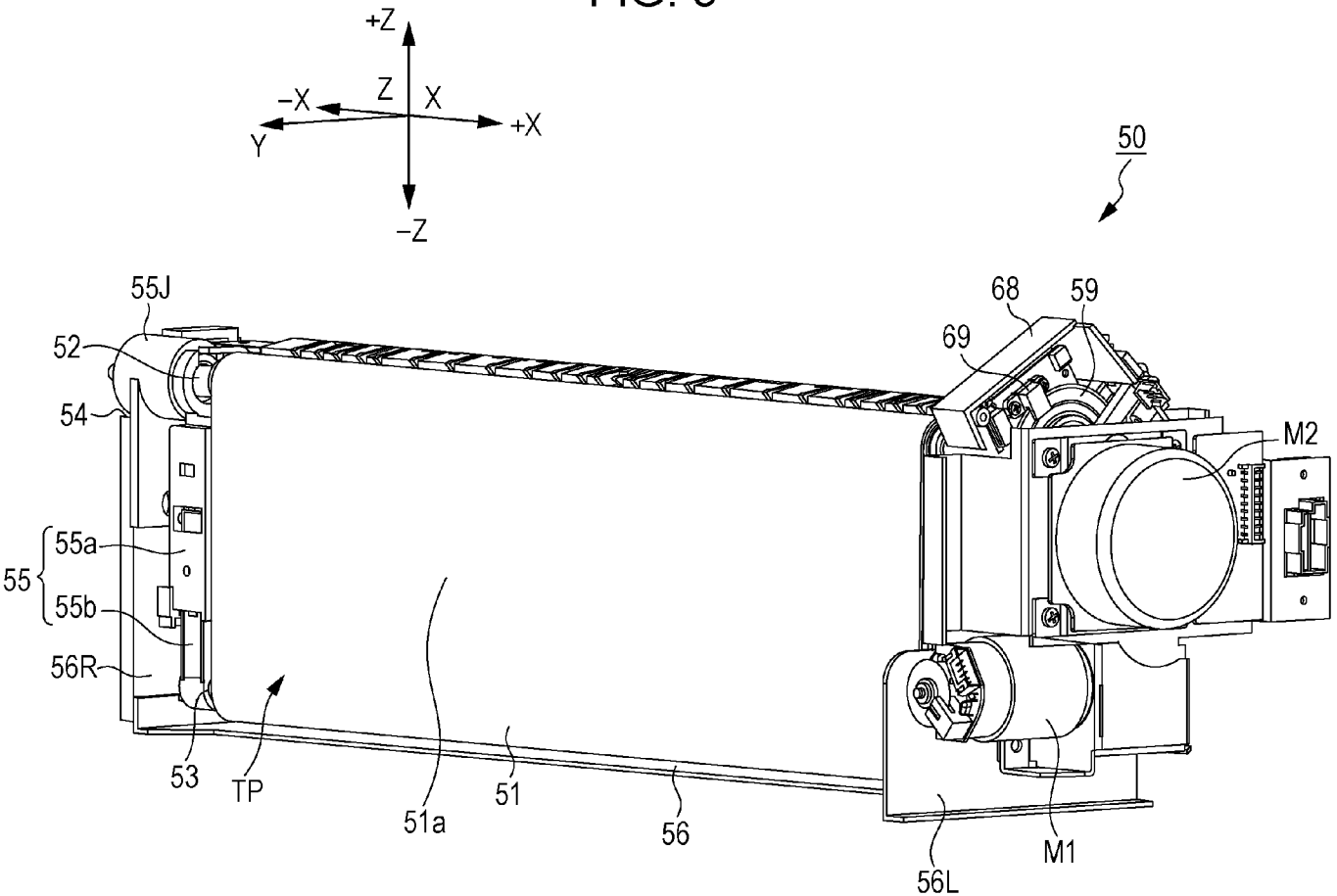
FIG. 5 is a perspective view illustrating the transport unit in which the transport belt is moved to a second position which is separated from the recording section.
Figure 6:
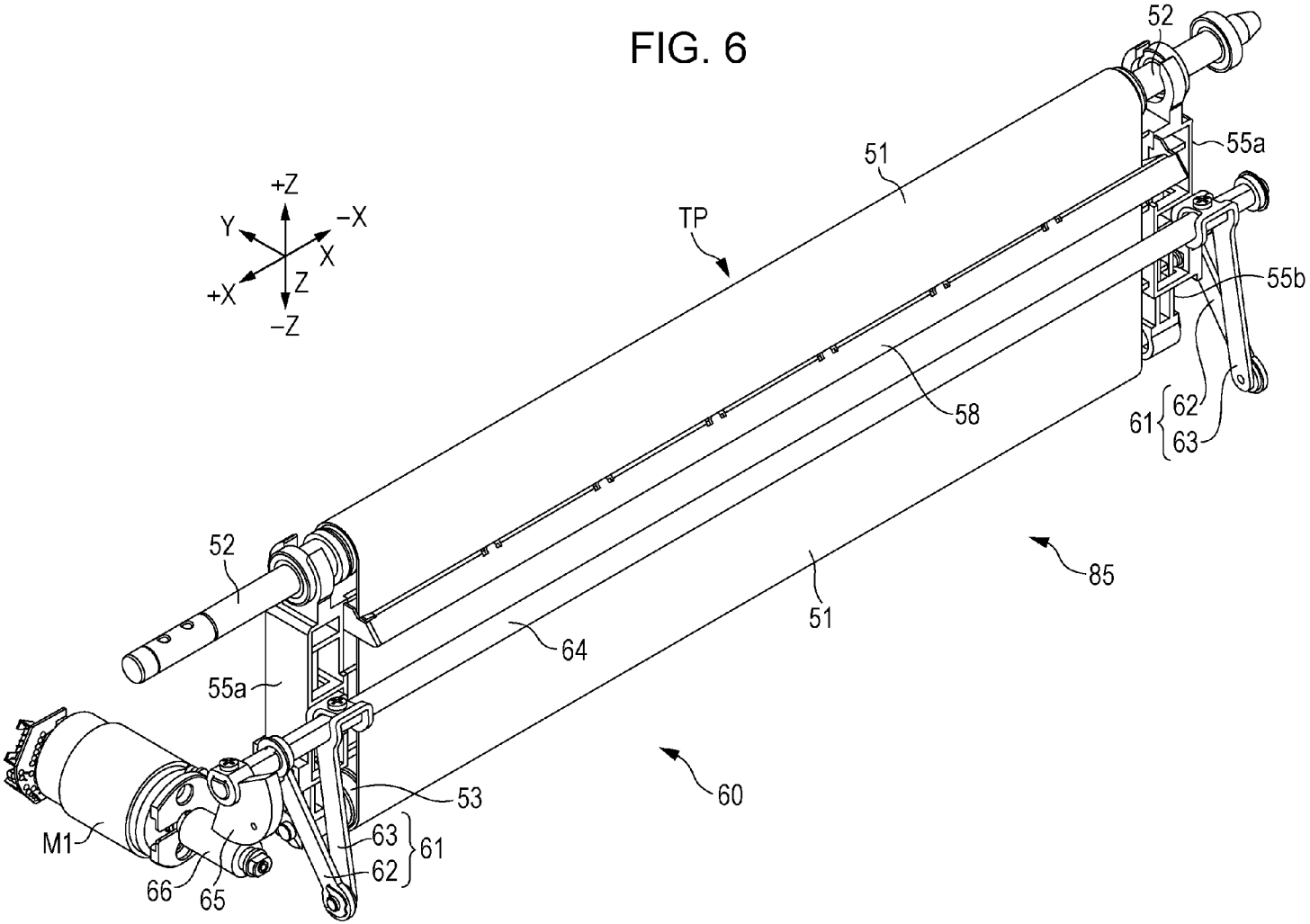
FIG. 6 is a perspective view illustrating the belt moving section in a state in which the transport belt is moved to the second position.

As shown in FIGS. 5 and 6, the transport belt 51 moves (swings) to the retreat position TP the same as the state which is shown in FIG. 2 due to movement of the belt frame body 55 by the belt moving section 60. At the retreat position TP, the transport belt 51 is set in a state of being housed within the unit frame 56 in a state in which the belt surface 51*a* is a substantially vertical plane along the vertical direction Z. Here, in FIG. 6, configuring members are exemplified according to the belt moving section 60 which moves the transport belt 51.

As shown in FIGS. 4 and 6, in the embodiment, the rotation of the first motor M1 is converted to rotation of the worm gear 65 which engages with the worm 66 that is attached to the rotary shaft (motor shaft). Accordingly, the rotary shaft 64 to which the worm gear 65 is attached rotates at a small rotation angle in comparison to the rotational speed of the first motor M1 (rotational speed of the worm 66). In other words, it is possible to rotate the rotary shaft 64 at a rotation angle with high precision using the rotation of the first motor M1. In addition, since the rotation direction of the worm gear 65 is a direction which intersects with the rotation direction of the worm 66, the rotation angle at which the rotary shaft 64 is rotated is maintained in a state in which the rotation of the first motor M1 is stopped. As a result, for example, in the transport unit 50, the belt surface 51*a* of the transport belt 51 which is set as a substantially horizontal plane is positioned with high positional precision at the recording position KP, and the belt surface 51*a* of the transport belt 51 which is set as a substantially vertical plane is positioned with high positional precision at the retreat position TP.

Here, in the embodiment, there is a configuration in which a state where the transport belt 51 is positioned at the recording position KP is sensed by controlling the amount of rotation of the first motor M1. Meanwhile, there is a configuration in which a state where the transport belt 51 is positioned at the retreat position TP is sensed by a detection sensor 56S (refer to FIG. 3) which is attached to the unit frame 56. Of course, there may be a configuration in which a detection sensor is provided that senses a state in which the transport belt 51 is positioned at the recording position KP, and a state is sensed in which the transport belt 51 is positioned at the recording position KP using the provided detection sensor.

Furthermore, as shown in FIGS. 3 and 5, in the embodiment, the transport belt 51 is added in a state of being moved to the recording position KP, and is rotatable even in a state of being moved to the retreat position TP in such a manner. That is, a transmission gear which is not shown is provided in the unit frame 56, and a second motor M2 is attached to a unit frame 56 as the driving source which rotates the transport belt 51 by rotatably driving the driving roller 52 via the transmission gear. Accordingly, the transport belt 51 is rotatable at the recording position KP and the retreat position TP due to the second motor M2 rotatably driving.

For this reason, on the side plate sections 56R and 56L of the unit frame 56, a bearing 54 (only the bearing 54 at the side plate section 56R side is exemplified in FIG. 5) which supports (axially supports) a roller shaft of the driving roller 52 so as to be rotatable via a roller support section 55J which supports the driving roller 52 is provided on the base section 55*a* of the belt frame body 55 so as to be rotatable.

In addition, a rotation detecting section which detects the amount of rotation of the driving roller 52 is provided on the transport unit 50. In the embodiment, an optical rotary encoder is adopted which uses a disc 59 and a photo-coupler 69 as the rotation detecting section. The disc 59 is attached to the driving roller 52. Meanwhile, the photo-coupler 69 is attached to a lid section 68 for covering the bearing 54 of the driving roller 52 which is provided on the side plate section 56L on the left direction (+X direction) side of the unit frame 56. Accordingly, the photo-coupler 69 which is attached to the lid section 68 functions as the detection sensor which detects the rotation of the disc 59 (rotation of the driving roller 52).

Figure 7:
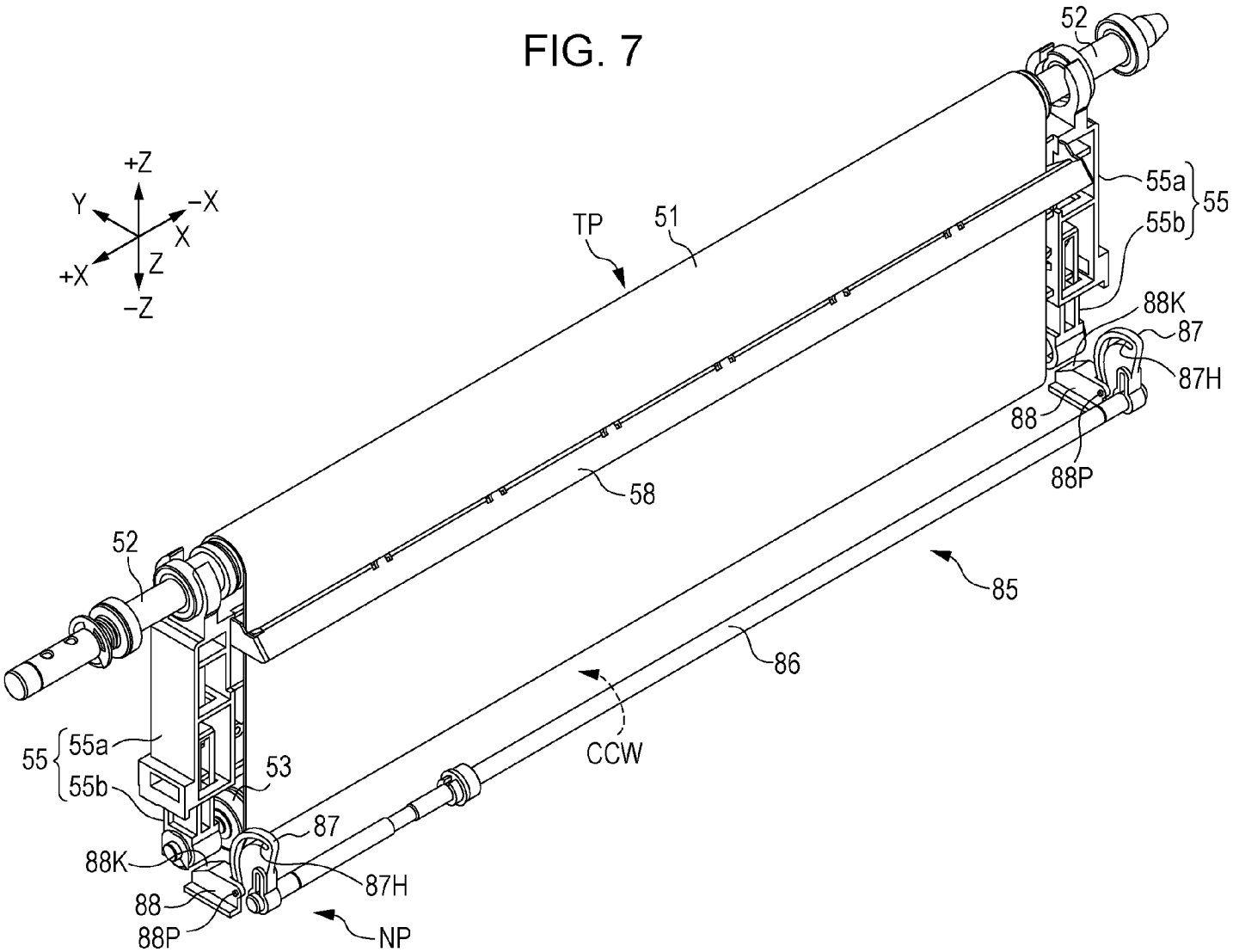
FIG. 7 is a perspective view illustrating a tension adjustment section which adjusts tension of the transport belt.
Figure 8:
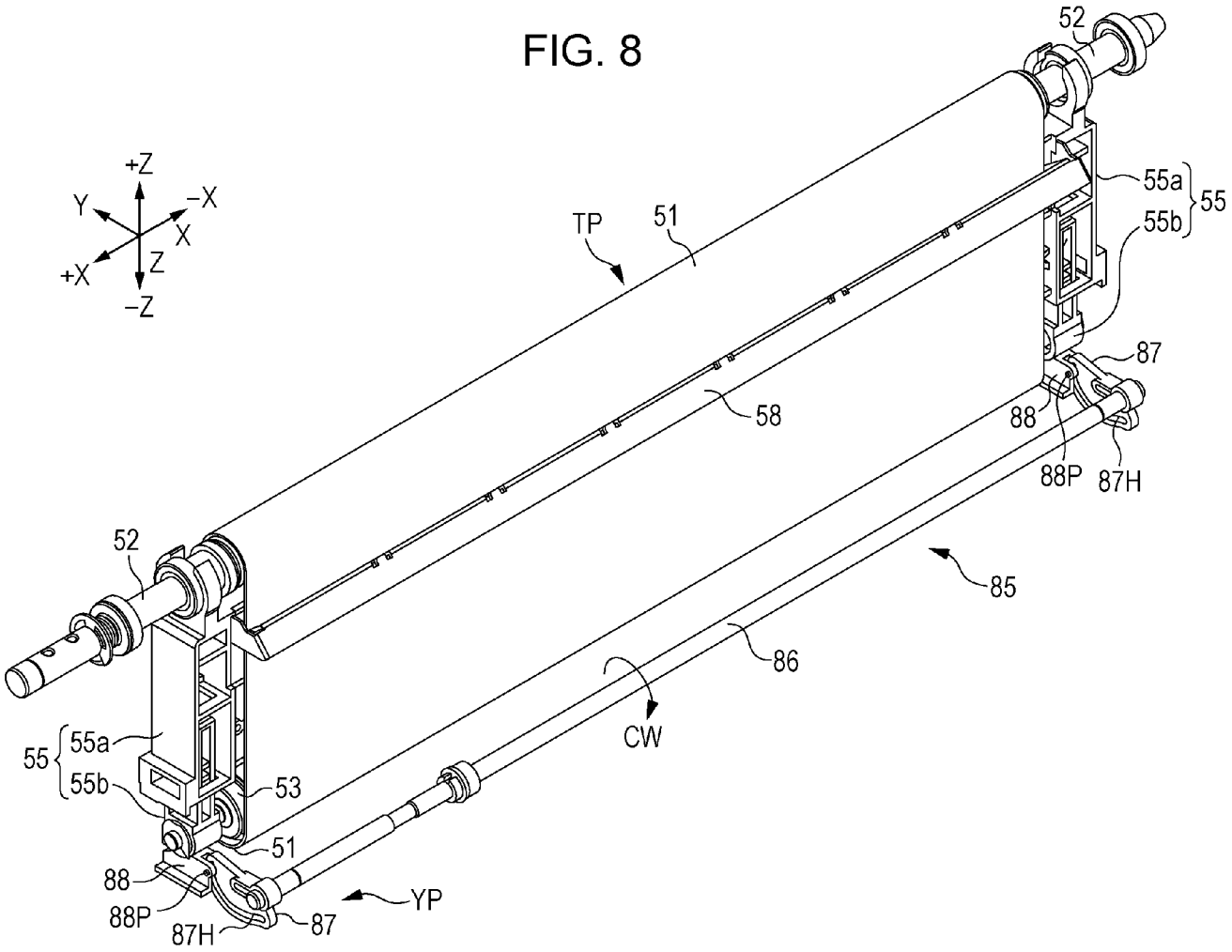
FIG. 8 is a perspective view illustrating the tension adjustment section in a state in which tension of the transport belt is adjusted.

As shown in FIGS. 7 and 8, in the embodiment, the tension adjustment section 85 which adjusts the tension applied to the transport belt 51 is provided in the transport unit 50. Here, in FIGS. 7 and 8, for ease of explanation, in the transport unit 50, a necessary configuration for describing the tension applied to the transport belt 51 is exemplified, and exemplification of other configuration elements such as the unit frame 56 or the belt moving section 60 are omitted.

The tension adjustment section 85 has a configuration in which the longitudinal direction (width direction X) of the transport unit 50 is set as an axis line direction, and includes the cam shaft 86 to which a tension adjustment cam 87 is attached to both sides, and a slider 88 which functions as a cam follower with respect to the tension adjustment cam 87. That is, a cam hole 87H which is bent so as to change a distance from the cam shaft 86 is provided in the tension adjustment cam 87, and a cam pin 88P which is fixed to the slider 88 is inserted into the cam hole 87H.

The cam shaft 86 is supported so as to freely rotate about the bearing 56J (refer to FIG. 3) which is provided in the unit frame 56, and is rotatable using the driving source which is not shown in the drawings. Then, the cam pin 88P which is inserted into the cam hole 87H is movable so as to be separated from and brought close to the cam shaft 86 due to the cam shaft 86 rotating.

That is, as indicated by the broken line arrow CCW in FIG. 7, the cam shaft 86 rotates in the counterclockwise direction viewed from the +X direction, and the cam pin 88P which is inserted into the cam hole 87H slidably moves the slider 88 by separating from the cam shaft 86 to the transport direction Y downstream side due to the tension adjustment cam 87 rotating (swinging) accompanying rotation of the cam shaft 86. In addition, as indicated by the solid line arrow CW in FIG. 8, the cam shaft 86 rotates in the clockwise direction viewed from the +X direction, and the cam pin 88P which is inserted into the cam hole 87H slidably moves the slider 88 by coming close to the cam shaft 86 to the transport direction Y upstream side due to the tension adjustment cam 87 rotating (swinging) accompanying rotation of the cam shaft 86. Here, the slider 88 in the embodiment is configured to slidably move along the transport direction Y to guide the bottom surface on the gravity direction −Z side to the unit frame 56 (refer to FIG. 3).

In the tension adjustment section 85 which is configured in this manner, the slider 88 moves between a position which is separated with respect to the belt frame body 55 (expansion and contraction section 55*b*) as shown in FIG. 7, and a position which comes into contact with the belt frame body 55 (expansion and contraction section 55*b*) by moving in the transport direction Y as shown in FIG. 8. The position at which the slider 88 is separated with respect to the belt frame body 55 is a non-tension adjustment position NP at which the tension of the transport belt 51 is not adjusted. Meanwhile, the position at which the slider 88 comes into contact with the belt frame body 55 is a tension adjustment position YP at which the tension of the transport belt 51 is adjusted. That is, at the tension adjustment position YP, the slider 88 comes into contact with the belt frame body 55 in a state of pressing the base section 55*a* such that the expansion and contraction section 55*b* of the belt frame body 55 is contracted. As a result, at the tension adjustment position YP, there is a configuration such that due to the pressing on the base section 55*a* of the expansion and contraction section 55*b*, the driven roller 53 is adjusted such that a distance to the driving roller 52 is shortened with respect to the driving roller 52, and tension of the transport belt 51 is lowered.

Here, as shown in FIGS. 6, 7, and 8, in the embodiment, in the transport unit 50, a paper dust removal blade 58 for removing paper dust which is adhered to the transport belt is fixed to the belt frame body 55. The paper dust removal blade 58 is provided with an extending section which extends along the width direction X so as to bridge between the base section 55*a* of the belt frame body 55 which is positioned at both ends of the transport belt 51 in the width direction X. The extending section is configured to remove paper powder from the belt surface 51*a* by scraping off paper dust which is adhered to the belt surface 51*a* from the belt surface 51*a* by coming into contact with the belt surface 51*a* or adhering the paper dust. In addition, the paper dust removal blade 58 is positioned more on the anti-gravity direction +Z side than a wall member 97 of the cleaning unit 90, that is, at the downstream side of the wall member 97 in the rotation direction of the transport belt 51 when cleaning the transport belt 51 in a state in which the transport belt 51 is positioned at the retreat position TP.

Figure 9:
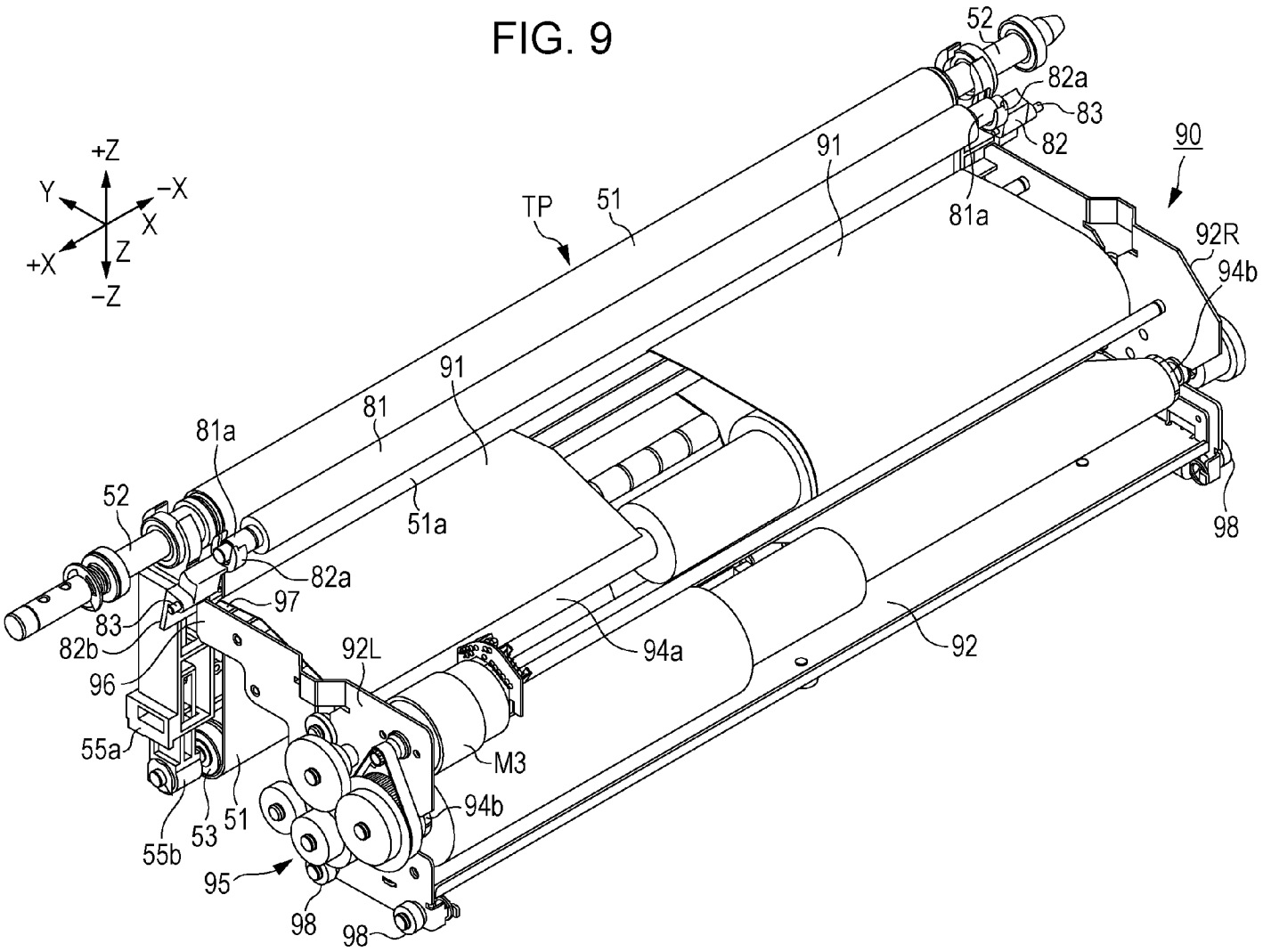
FIG. 9 is a perspective view illustrating a cleaning unit, which has a cleaning member, and a charging roller.

In addition, as shown in FIG. 9, in the printer 11 in the embodiment, the cleaning unit 90 is provided (refer to FIGS. 1 and 2) which has the cleaning member 91 for removing (cleaning) by wiping off dirt that is adhered to the belt surface 51*a* of the transport belt 51. Here, in FIG. 9, necessary components for describing the cleaning of the charging roller 81, the cleaning unit 90, and the transport belt 51 are exemplified, and exemplification of other configuration elements such as the unit frame 56 or the belt moving section 60 are omitted.

In the cleaning unit 90, the cleaning member 91 such as a woven fabric (web) is attached in a state of being wound in a roll form on a roll core with a round shaft form on the base frame 92 which is provided with a right side wall section 92R and a left side wall section 92L on both sides in the width direction X which is intersects with the transport direction Y.

In detail, in the embodiment, the cleaning unit 90 has a roll core 94*a* on an unwinding side of the cleaning member 91 and a roll core 94*b* on a winding side, both end sections of the respective roll cores 94*a* and 94*b* are attached so as to freely rotate respectively with the right side wall section 92R and the left side wall section 92L. Then, the cleaning member 91 which is wound on the roll core 94*a* on the unwinding side has substantially the same length as the length of the transport belt 51 in the width direction X in the axis line direction (width direction X) of the roll core 94*a*, and is wound on the roll core 94*b* on the winding side. In the embodiment, the roll core 94*a* on the unwinding side is positioned above the roll core 94*b*, which is on the winding side, on the anti-gravity direction +Z side.

Here, FIG. 9 exemplifies a state in which the cleaning member 91 is wound on two respective separate portions in the axis line direction (width direction X) of the roll core 94*a* on the unwinding side, and similarly the cleaning member 91 is wound on two separate portions in the axis line direction (width direction X) of the roll core 94*b* on the winding side. Here, for ease of understanding of the attachment structure of the cleaning member 91, one drawing indicates the unwinding state and the winding state of the cleaning member 91. That is, in each roll core 94*a* and 94*b*, a start state in which the cleaning member 91 is substantially unwound on the right side wall section 92R side is exemplified, and an end state in which the cleaning member 91 is substantially unwound on the left side wall section 92L side is exemplified.

In addition, the cleaning unit 90 is provided with a power transmission mechanism 95 using a plurality of teeth on the left side wall section 92L of the base frame 92, and similarly the roll core 94*b* is rotated by transmitting the rotational driving of a third motor M3, as the driving source which is attached to the left side wall section 92L, to the roll core 94*b* on the winding side using the power transmission mechanism 95. Due to the rotation of the roll core 94*b* on the winding side, the cleaning member 91 which is wound on the roll core 94*a* on the unwinding side is unwound, and is wound on the roll core 94*b* on the winding side by moving while guiding to a plurality of rollers which are attached so as to freely rotate on the base frame 92.

An extending section 96 which extends to the transport direction Y downstream side toward the transport belt 51 that is moved to the retreat position TP is provided on the right side wall section 92R and the left side wall section 92L of the base frame 92. In the extending section 96, the wall member 97 (refer to FIG. 12A) that is provided such that a wall surface, which is a surface substantially parallel to the belt surface 51*a* of the transport belt 51 that is moved to the retreat position TP and extends in the width direction X, faces the transport direction Y downstream side. The cleaning member 91 moves toward the wall surface of the wall member 97 when winding on the roll core 94*b* on the winding side. Here, in the plurality of rollers which guide the movement of the cleaning member 91, the roller at the roll core 94*a* side more on the unwinding side than the wall member 97 is positioned further above the anti-gravity direction +Z side than a roller which is on the roll core 94*b* side that is more on the winding side than the wall member 97.

Furthermore, in the embodiment, in the base frame 92, the cleaning unit 90 is slidably movable along the transport direction Y by rolling rollers 98 which are attached to the lower end section at both sides in the width direction X to freely rotate along a guide rail which is not shown in the drawings. That is, the cleaning unit 90 is configured to rotate the rollers 98 by being pushed or pulled by the base frame 92 along the transport direction Y using, for example, a driving source which is not shown in the drawings (for example, an actuator), and reciprocally moves (slidably moves) along the transport direction Y. Along with the movement of the cleaning unit 90, the cleaning member 91 slidably moves along the transport direction Y. Accordingly, in the embodiment, the rollers 98 function as a portion of a cleaning member moving section which moves the cleaning unit 90.

The cleaning member moving section positions (refer to FIG. 12A) the cleaning member 91 which moves along a wall surface of the wall member 97 at a separation position (also referred to as "cleaning member separation position CRP") which is separated from the transport belt 51 by moving the cleaning unit 90 to the transport direction Y upstream side. In addition, the cleaning member moving section positions (refer to FIG. 12C) the cleaning member 91 which moves along the wall surface of the wall member 97 at a contact position (also referred to as "cleaning member contact position CSP") which comes into contact with the transport belt 51 by moving the cleaning unit 90 to the transport direction Y downstream side. Accordingly, the cleaning unit 90 moves between the cleaning member separation position CRP and the cleaning member contact position CSP using the cleaning member moving section.

In addition, as shown in FIG. 9, in the embodiment, in the cleaning unit 90, the extending sections 96 of the left side wall section 92L and right side wall section 92R of the base frame 92 come into contact with a bearing member 82 which axially supports the roller shaft 81*a* at both ends of the charging roller 81 so as to respectively freely rotate at the same time as the cleaning member 91 comes into contact with the transport belt 51. Due the contact, each extending section 96 is configured to respectively rotate the bearing member 82. The configuration will be described below with the extending section 96 of the left side wall section 92L of the base frame 92 as an example. Here, the extending section 96 of the right side wall section 92R of the base frame 92 is configured in the same manner.

Figure 10A:
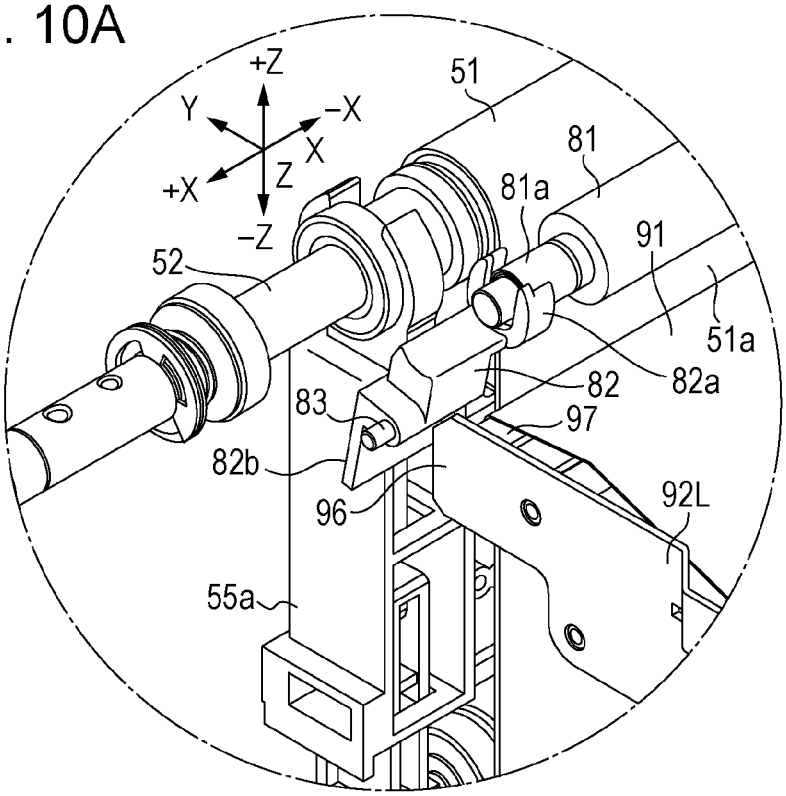
FIGS. 10A and 10B are partially enlarged views illustrating an abutting section between the cleaning unit and the charging roller.

As shown in FIG. 10A, the bearing member 82 has a round pin 83 which is axially supported so as to freely rotate in the casing 12 of the printer 11, and with respect to the round pin 83, a bearing section 82*a* which receives the roller shaft 81*a* of the charging roller 81 is formed on the anti-gravity direction +Z side and a lever section 82*b* with a substantially flat plate form is formed on the gravity direction −Z side. Then, accompanying the cleaning unit 90 moving to the transport direction Y downstream side, the bearing member 82 is configured to rotate about the round pin 83 by pushing the lever section 82*b* on the transport direction Y downstream side while the extending section 96 of the left side wall section 92L of the base frame 92 comes into contact with the lever section 82*b* of the bearing member 82.

In addition, the bearing member 82 is biased in a direction in which the charging roller 81 comes into contact with the transport belt 51 by the biasing member such as a spring which is not shown in the drawings. Accordingly, in a state in which the extending section 96 of the left side wall section 92L of the base frame 92 does not come into contact with the lever section 82*b* of the bearing member 82, the transport belt 51 is positioned at the contact position which comes into contact with the transport belt 51 so as to interpose the driving roller 52.

Figure 10B:
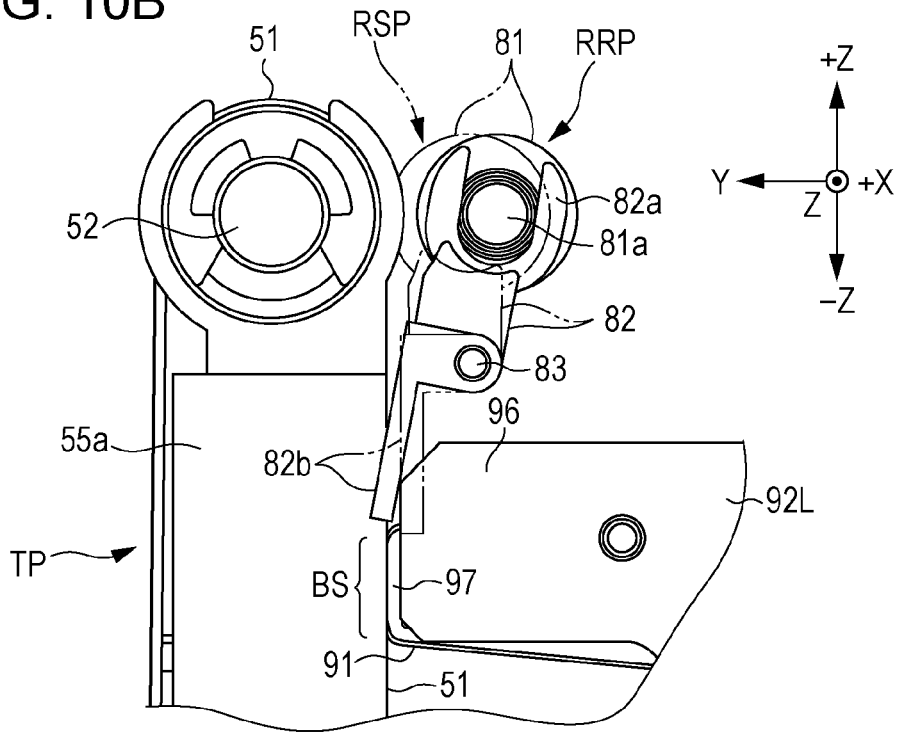

As a result, as indicated by the chain double-dashed line in FIG. 10B, the charging roller 81 which is positioned at the contact position which comes into contact with the transport belt 51 moves to the separation position which is separated from the transport belt 51 as indicated by the solid line in FIG. 10B by rotating the bearing member 82 with the round pin 83 as the center by the extending section 96 coming into contact with the lever section 82*b*.

In this manner, in the embodiment, the cleaning unit 90 moves the charging roller 81 between the contact position which comes into contact with the transport belt 51 and the separation position which is separated from the transport belt 51 more than the contact position in conjunction with sliding movement between the cleaning member separation position CRP and the cleaning member contact position CSP along the transport direction Y. That is, the cleaning unit 90 functions as a charging roller moving section. Here, in the embodiment, with respect to the transport belt 51, the contact position of the charging roller 81 is also referred to as a "roller contact position RSP", and the separation position of the charging roller 81 is also referred to as a "roller separation position RRP".

As shown in FIG. 10B, a belt contact section BS in which a portion that is present along the wall surface of the wall member 97 in the cleaning member 91 comes into contact is formed on the transport belt 51 which is moved to the retreat position TP along the width direction X which intersects with the rotation direction of the transport belt 51. In the embodiment, at least a portion of the belt contact section BS is supported by the belt frame body 55 from the opposite side from the contact side of the cleaning member 91. Accordingly, the belt frame body 55 functions as a belt support section which supports the transport belt 51. That is, in the embodiment, the base section 55*a* is configured to function as the belt support section, and support substantially all of the belt contact section BS.

Next, the actions of the embodiment will be described.

In the embodiment, as the actions, in a case where the transport belt 51 is estimated to be dirty, an operation process is performed which cleans the transport belt 51. In addition, in a case where recording (printing) is not performed by the recording section 18, the operation process is performed which adjusts the tension of the transport belt 51. Here, the operation process is configured by a central processing unit (CPU), a storage device (memory), and the like, and the operation process is performed by a control section of the printer 11 which controls a printing process such as a process in which ink is discharged in the recording section 18 drive controlling each driving source and the like in a predetermined order.

First, the cleaning operation process of the transport belt 51 will be described with reference to FIG. 11.

Figure 11:
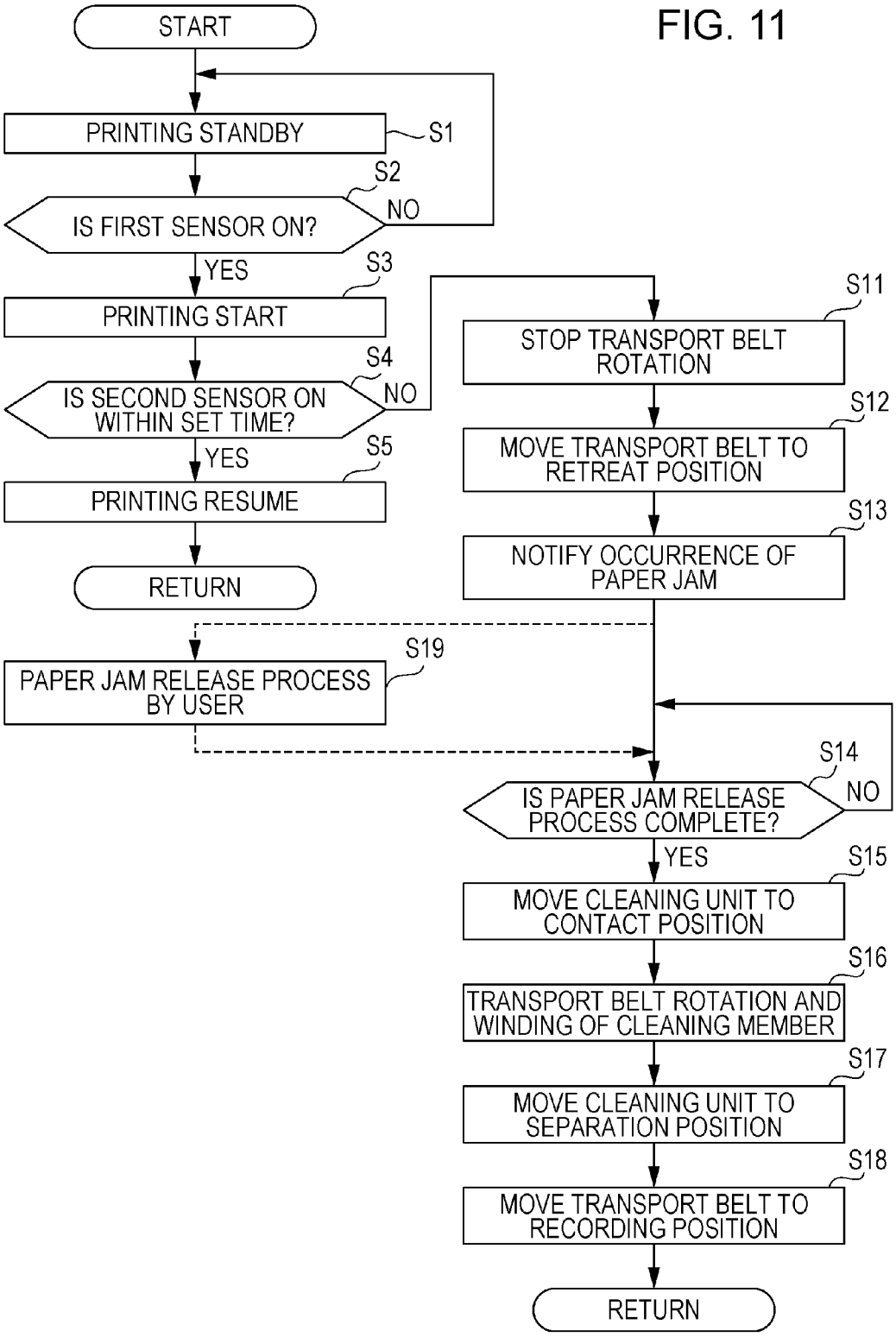
FIG. 11 is a flow chart illustrating a cleaning operation in which the transport belt is cleaned.

As shown in FIG. 11, when the operation process is started, in step S1, a process is performed in which a printing standby state is set in which it is possible to discharge ink from the recording section 18 in the printer 11, and subsequently in step S2, a determination process is performed of whether or not the first sensor Sa is turned "ON", that is, whether or not the paper 14 is detected. Then, until the first sensor Sa is turned "ON" (step S2: YES), the determination process of step S2 is repeated, if the first sensor Sa is turned "ON", in the subsequent step S3, for example, a process in which printing is started based on the printing data which is input to the printer 11, that is, a process in which the ink discharge in the recording section 18 starts is performed.

Subsequently, determination is performed of whether or not the second sensor Sb is turned "ON" within a set time in step S4, that is, whether or not an elapsed time from the first sensor Sa detecting the paper 14 to the second sensor Sb detecting the paper 14 is within the set time. In the embodiment, a reaching time from the first sensor Sa to the second sensor Sb of a case of the paper 14 being transported along the transport path 13 without delay is set in advance, and the control section performs the determination process of step S4 using the set time.

Then, in a case where the second sensor Sb is turned "ON" and detects the paper 14 within the set time (step S4: YES), since the paper 14 is transported on the transport path 13 without delay, after a current printing resumption process is performed in the subsequent step S5, the process returns to the printing standby state (step S1) which is to be performed in subsequent printing.

Meanwhile, in a case where the second sensor Sb is not turned "ON" within the set time, that is, in a case where the second sensor Sb does not detect the paper 14 (step S4: NO), the paper 14 is estimated to be in a jam state in which transport of the paper 14 by the transport belt 51 on the transport path 13 is delayed, and the process transitions from step S11 to step S18. In a case where the paper 14 is in a jam state (paper jam) in this manner, it is possible that adherence of ink which is discharged in the recording section 18 to the transport belt 51 without being adhered to the paper 14 occurs. That is, in a case where the transport belt 51 is made dirty by the occurrence of a paper jam, it is possible to estimate that the transport belt 51 is made dirty due to the adherence of ink by detecting the jam state in which transport by the transport belt 51 on the transport path 13 is delayed using the process in step S4. Accordingly, the control section functions as a dirt estimation section which estimates that there is dirt on the transport belt 51 by the determination process in step S4 using the first sensor Sa and the second sensor Sb.

In step S11 which is performed subsequently to step S4, a rotation stop process for the transport belt 51 is performed, and in the subsequent step S12, a process is performed in which the transport belt 51 is moved from the recording position KP to the retreat position TP. Then, in the subsequent step S13, a process is performed in which notification is made of the paper jam occurrence.

In the embodiment, a display section which is not shown in the drawings is provided in the casing 12 of the printer 11, and for example, the display section displays notification wording and notification color such as for "paper jam occurred". Alternatively, a pronunciation section which is not shown in the drawings is provided in the casing 12 of the printer 11, and using the pronunciation section, words such as "paper jam occurred" are pronounced or a notification sound is pronounced.

Next, in step S14, a determination process is performed of whether or not a paper jam release process has ended. In the embodiment, after the notification process in step S13, as indicated in step S19 in FIG. 11, the paper jam release process is performed by a user. There are cases where, for example, the user performs the paper jam release process by opening a cover which covers an opening section which is provided in a portion of the casing 12, removing the paper 14 which is in a jam state via the exposed opening section, and covering the opening section by closing the cover again. In such a case, the control section determines that the paper jam release process has ended by detecting a state in which the cover which covers the opening section is closed using a sensor or the like. Alternatively, the user inputs a signal which indicates that the releasing of the paper jam has ended using input means which is not shown in the drawings, and the control section determines that the paper jam release process has ended by detecting the input signal. Then, when it is determined that the paper jam release process has ended (step S14: YES), since the paper 14 is in a state of being transportable along the transport path 13, the process transitions to step S15.

Next, in step S15, a process is performed in which the cleaning unit 90 is moved (slidably moved) to the contact position (cleaning member contact position) where the cleaning member 91 comes into contact with the transport belt 51, and in the subsequent step S16, a process is performed of rotating the transport belt 51 and winding the cleaning member 91. By the processes in step S15 and step S16, the cleaning member 91 of the cleaning unit 90 moves a portion which forms the belt contact section BS of the transport belt 51 that is present along the wall surface of the wall member 97 in a reverse direction from the rotation direction of the rotating transport belt 51.

In this manner, cleaning efficiency is improved by moving the portion which forms the belt contact section BS in the cleaning member 91 in a reverse direction from the rotation direction of the transport belt 51. For example, it is easy to wipe away ink which is adhered to the transport belt 51 using the cleaning member 91. Alternatively, efficiency of wiping away such that no ink remains using the cleaning member 91 is increased. Of course, it is preferable that the cleaning member 91 adjusts the amount of movement of the portion that is present along the wall member 97 on which the belt contact section BS is formed on the transport belt 51 according to a dirt condition of the transport belt 51. For example, in a case where there is little dirt on the transport belt 51, it is preferable to slow down the rotation speed of the roll core 94*b* on the winding side and wind in a state in which the amount of movement of the cleaning member 91 for a unit time is slight.

The process from step S11 to step S16 will be supplementarily described with reference to FIGS. 12A to 12C. Here, in FIGS. 12A to 12C, in the cleaning unit 90, a state of unwinding and a state of winding of the cleaning member 91 are exemplified in one drawing.

Figure 12A:
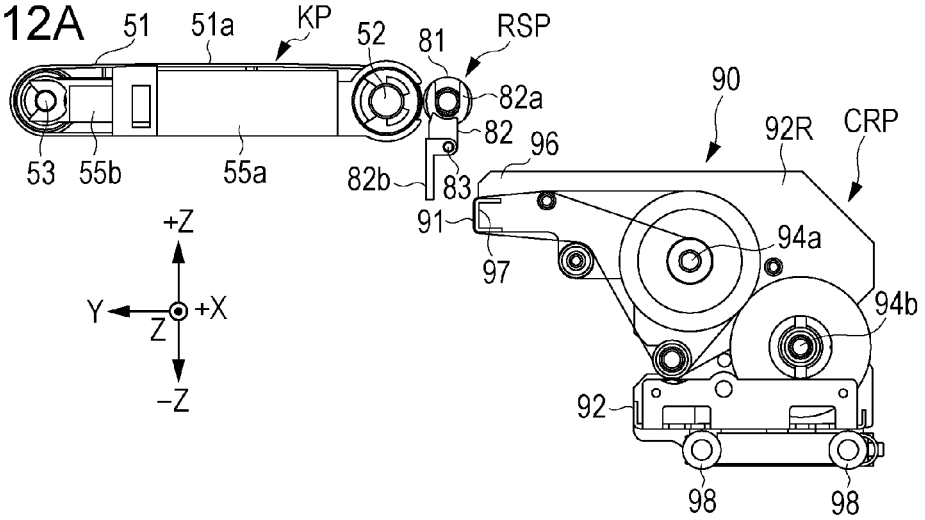
FIGS. 12A to 12C are schematic views for describing the state of the cleaning operation.

First, as shown in FIG. 12A, in the printer 11, in a case of the process before transitioning to step S11, that is, the printing standby state or the printing resumption state, the transport belt 51 is positioned at the recording position KP, and the charging roller 81 is positioned at the roller contact position which comes into contact with the transport belt 51. Of course, the cleaning unit 90 is positioned at the cleaning member separation position CRP which is separated from the lever section 82*b* of the bearing member 82 on the transport direction Y downstream side.

Figure 12B:
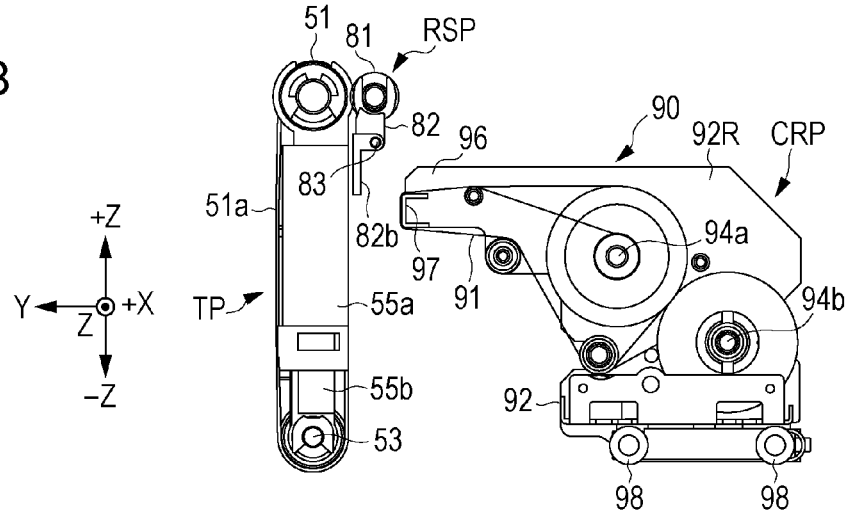

Next, as shown in FIG. 12B, by the process in step S12, the transport belt 51 rotates (swings) with the driving roller 52 as the center, and moves from the recording position KP to the retreat position TP. In the state in which the transport belt 51 is moved to the retreat position TP, the charging roller 81 maintains the connection state with the transport belt 51. In addition, since the rotation of the transport belt 51 is stopped by the process in step S11, the belt surface 51*a* which is made dirty by ink adhering is suppressed so as not to move to a position which comes into contact with the charging roller 81.

Figure 12C:
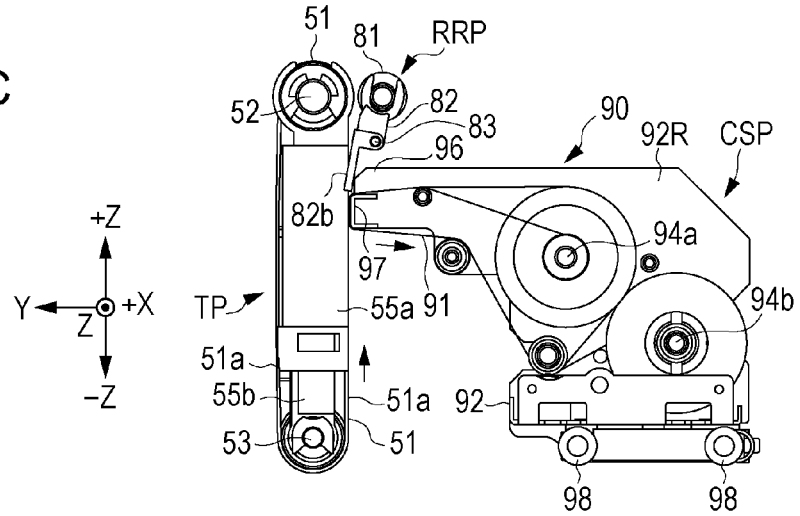

Next, as shown in FIG. 12C, due to the process in step S15, the cleaning unit 90 slidably moves due to the rotation of the rollers 98 from the cleaning member separation position CRP to the cleaning member contact position CSP. Due to the movement of the cleaning unit 90 to the cleaning member contact position, the charging roller 81 moves from the roller contact position RSP with the transport belt 51 to the roller separation position RRP. Then, by the process in step S16, as indicated by the arrow in FIG. 12C, ink which is attached to the belt surface 51*a* of the transport belt 51 is wiped away by the cleaning member 91 by the cleaning member 91 moving in the reverse direction from the rotation direction of the transport belt 51. Then, the portion which wipes away the ink in the cleaning member 91 is guided by a roller to the roll core 94*b* side more on the winding side than the wall member 97, and wound on the roll core 94*b*.

Accordingly, in the embodiment, in the cleaning unit 90, since the roll core 94*a* on the unwinding side is above the roll core 94*b* on the winding side, the cleaning member 91 on the roll core 94*a* side on the unwinding side is suppressed from being made dirty even if the ink which is wiped away from the cleaning member 91 drips. In addition, in the roller which guides the movement of the cleaning member 91, even if the ink from the roller which is on the roll core 94*b* side more on the winding side than the wall member 97 drips, the cleaning member 91 which is guided to the roller on the roll core 94*a* side on the unwinding side which is positioned above the roller which is on the roll core 94*b* side on the winding side is suppressed from being made dirty.

Here, in the embodiment, the charging roller 81 is configured to be positioned more on the rotation direction downstream side of the transport belt 51 than the cleaning member 91, and ink which is adhered to the belt surface 51*a* of the transport belt 51 is wiped away by the cleaning member 91 before reaching the charging roller 81. Of course, even in a case where the cleaning member 91 passes through in a state in which ink that is not wiped away and remains is adhered to the belt surface 51*a*, since the charging roller 81 moves to the roller separation position RRP which is separated from the belt surface 51*a* of the transport belt 51, the ink which is adhered to the belt surface 51*a* is suppressed from transferring to the charging roller 81.

In addition, although exemplification is omitted from FIGS. 12A to 12C, the paper dust removal blade 58 is also positioned on the downstream side of the wall member 97 in the rotation direction of the transport belt 51 in a state in which the transport belt 51 is positioned at the retreat position TP. For this reason, the ink which is adhered to the belt surface 51*a* of the transport belt 51 is wiped away by the cleaning member 91 before reaching the paper dust removal blade 58, and the paper dust removal blade 58 suppresses the transport belt 51 from becoming dirty due to the ink.

Returning to FIG. 11, in the subsequent step S17, a process is performed in which the cleaning unit 90 slidably moves from the cleaning member contact position to the separation position (cleaning member separation position CRP) which is separated from the transport belt 51. The charging roller 81 moves from the separation position (roller separation position RRP) from the transport belt 51 to the contact position (roller contact position RSP) due to the movement of the cleaning unit 90 to the cleaning member separation position CRP. Here, in the embodiment, in the process in step S16, a time is set in advance at which it is estimated that the wiping away by the cleaning member 91 of ink which is adhered to the transport belt 51 has ended, and after the time has elapsed, the process in step S17 is performed.

Then, in step S18, the transport belt 51 moves from the retreat position TP to the recording position KP, and the process returns to the printing standby state (step S1) which is to be provided in a process in which the paper 14 is transported to be printed on. In the embodiment, in this manner, an operation process is performed in which the transport belt 51 is cleaned.

The operation process in which the tension of the transport belt 51 is adjusted will be described below with reference to FIG. 13.

Figure 13:
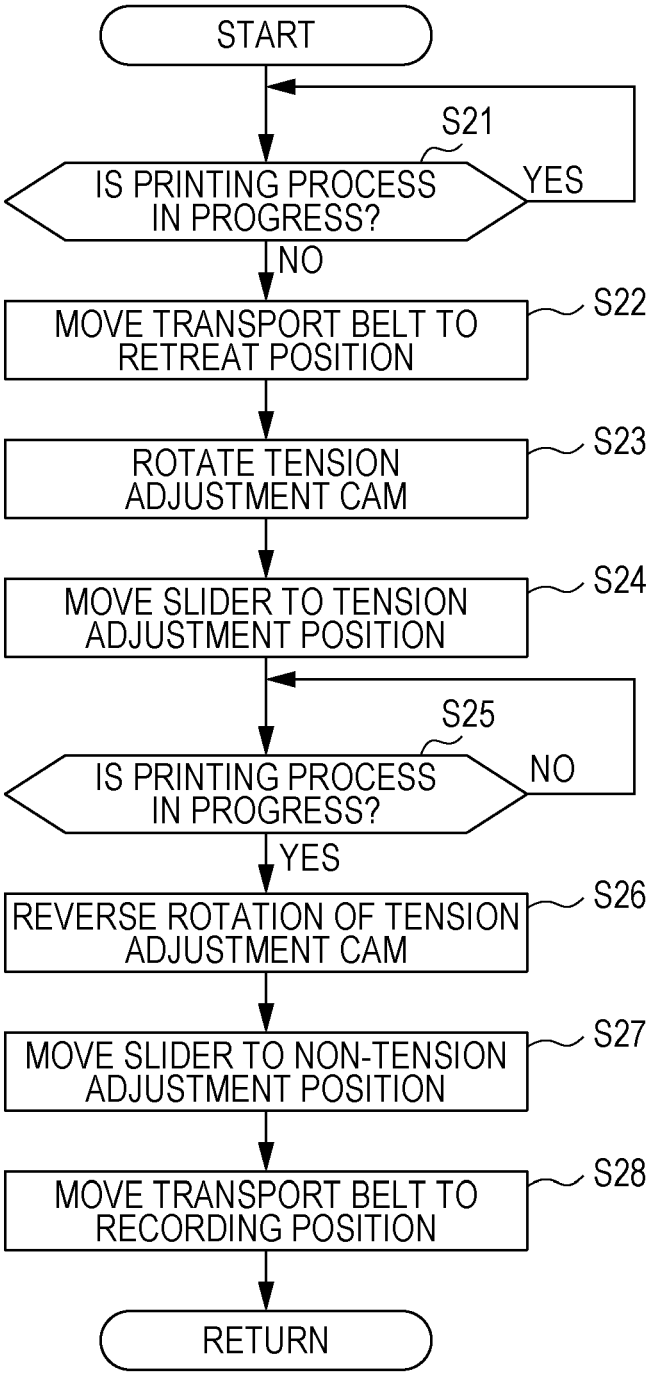
FIG. 13 is a flow chart illustrating a tension adjustment operation which adjusts tension of the transport belt.

As shown in FIG. 13, when the operation process is started, in step S21, a determination process is performed of whether or not the printer 11 is in the process of printing, and in a case where it is determined that the printer 11 is not in the process of printing (step S21: NO), the process transitions to step S22. That is, the operation process in which the tension of the transport belt 51 is adjusted is performed in a case where recording (printing) is not performed by the recording section 18.

In the embodiment, for example, there is a case where in the printer 11, a period until it is possible to print after the power is switched on is not recorded by the recording section 18. In addition, a case where printing data on printing non-execution does not exist in the printer 11, or a case where the printing data is not input (transmitted) may be a case where recording is not performed by the recording section 18.

Alternatively, in the printer 11, as an example of a maintenance process of the recording section 18 which maintains the ink discharge performance, other than a case in which recording is performed by the recording section 18 on the paper 14, there may be a case of a so-called flushing process in which ink is discharged, and there may be a case where recording is not performed by the recording section 18. In such a case, it is possible to determine the case in which recording is not performed by the recording section 18 by detecting whether or not the flushing process is set in the printer 11.

In addition, as another example of the maintenance process of the recording section 18 which maintains the ink discharge performance, a case of a capping process in which the recording section 18 is covered by a cap 71 may be the case in which recording is not performed by the recording section 18. In the case of the capping process, it is possible to determine the case in which recording is not performed by the recording section 18 by detecting the movement of the cap 71 toward the recording section 18. Meanwhile, in the capping process, in a case of a configuration in which the recording section 18 moves so as to come close to the cap 71 which is moved or the cap 71 which is fixed, it is possible to determine the case in which recording is not performed by the recording section 18 by detecting movement of the recording section 18 with respect to the cap 71.

In step S22, a process is performed in which the transport belt 51 moves to the retreat position TP. Then, in the subsequent step S23, a process is performed in which the tension adjustment cam 87 is rotated, and in the subsequent step S24, a process is performed in which the slider 88 is moved to the tension adjustment position YP. Due to the processes in step S23 and step S24, the tension of the transport belt 51 is adjusted to a lower tension than the tension when the recording section 18 performs printing (recording) on the paper 14. Here, in the embodiment, the transport belt 51 is adjusted in a state in which tension is not applied to the transport belt 51, that is, a state in which tension is released. That is, the tension adjustment position YP to which the slider 88 is moved is also a tension release position of the transport belt 51.

The process from step S22 to step S24 will be supplementarily described with reference to FIGS. 14A to 14C.

Figure 14A:
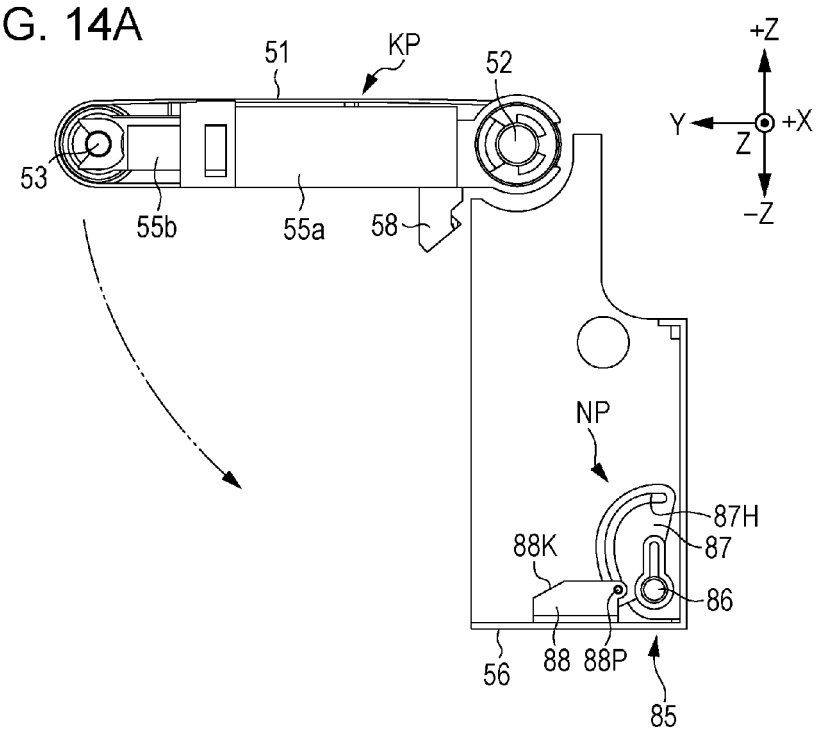
FIGS. 14A to 14C are schematic views for describing the state of the tension adjustment operation.

First, as shown in FIG. 14A, in a case of a state in which the printer 11 is not in the process of printing, the transport belt 51 moves (swings) from the recording position KP during the printing process toward the retreat position TP as indicated by the chain double-dashed line arrow in FIG. 14A. At this time, in the embodiment, the slider 88 of the tension adjustment section 85 is positioned at the non-tension adjustment position NP which is positioned during the printing process (refer to FIG. 7).

Figure 14B:
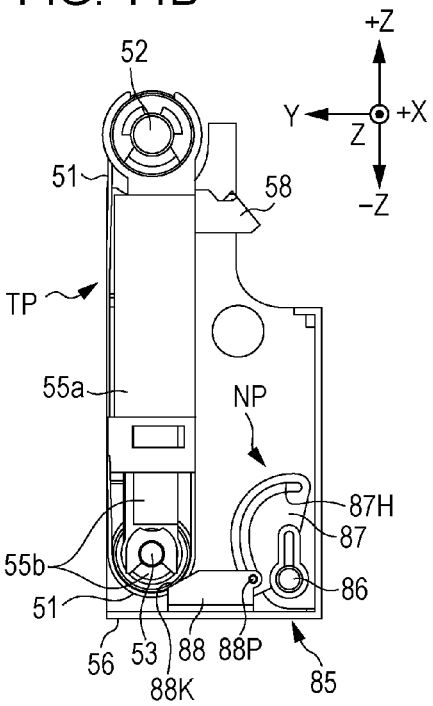

Next, as shown in FIG. 14B, by the process in step S22, the transport belt 51 rotates (swings) with the driving roller 52 as the center, and moves from the recording position KP to the retreat position TP. Here, in the state in which the transport belt 51 is moved to the retreat position TP, the slider 88 is set in a state of being positioned without change at the non-tension adjustment position NP which is separated from the driven roller 53 of the transport belt 51.

Figure 14C:
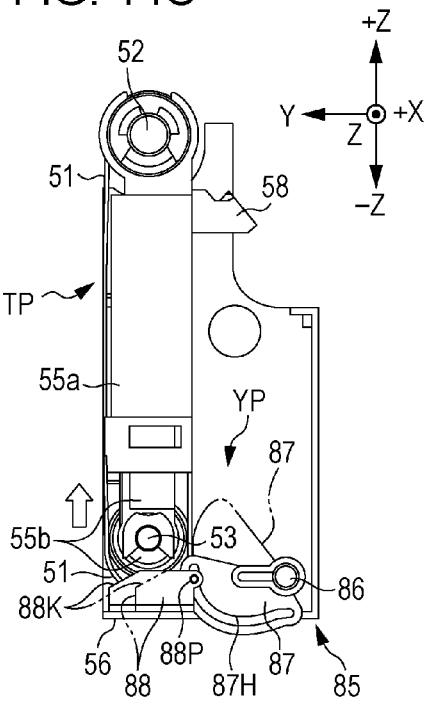

Next, as shown in FIG. 14C, by the processes in step S23 and step S24, in the tension adjustment section 85, the tension adjustment cam 87 rotates as indicated by the solid line in FIG. 14C, and the slider 88 slidably moves from the non-tension adjustment position NP to the tension adjustment position YP (refer to FIG. 8). Due to the movement to the tension adjustment position YP, the slider 88 is moved to the anti-gravity direction +Z side such that, with respect to the driving roller 52, the driven roller 53 shortens the distance to the driving roller 52 by coming into contact with the expansion and contraction section 55*b* of the belt frame body 55 and pushing the contacted expansion and contraction section 55*b* onto the base section 55*a* as indicated by the white arrow in FIG. 14C. In the embodiment, the slider 88 moves the driven roller 53 in the anti-gravity direction +Z until a state in which the driven roller 53 is separated from the transport belt 51 in the vertical direction Z, and releases tension applied to the transport belt 51.

Of course, in the embodiment, the tension applied to the transport belt 51 may be adjusted not to be released, but to a lower tension than the tension which is applied to the transport belt 51 in the state of being positioned at the recording position KP. In this case, in step S23, as indicated by the chain double-dashed line in FIG. 14C, an inclined surface 88K which is provided on the transport direction Y downstream side of the slider 88 is moved to a position which comes into contact with the expansion and contraction section 55*b* at the position prior to the tension adjustment position YP by adjusting the amount of rotation of the tension adjustment cam 87. By doing so, the amount of movement of the driven roller 53 which moves along with the expansion and contraction section 55*b* is adjusted due to the inclined surface 88K of the slider 88, and as a result, a reduced amount of tension is applied to the transport belt 51.

Retuning to FIG. 13, in the subsequent step S25, a determination process is performed of whether or not the printer 11 is again in the process of printing, and in a case where it is currently determined that it is during the printing process (step S22: YES), the process transitions to step S26 and thereafter in a state to be set in which printing (recording) is performed by the recording section 18.

First, in the subsequent step S26, a process is performed in which the tension adjustment cam 87 is rotated in reverse, and in the subsequent step S27, a process is performed in which the slider 88 is moved to the non-tension adjustment position NP. That is, the tension adjustment cam 87 is rotated in the reverse direction from the rotation direction in step S23, and the slider 88 is slidably moved in a direction which is separated from the driven roller 53 (refer to FIGS. 14C and 14B). Then, in the subsequent step S28, a process is performed in which the transport belt 51 is rotated (swung) with the driving roller 52 as the center and moved from the retreat position TP to the recording position KP, and comes to be in a state in which printing is performed on the paper 14 by the recording section 18 (refer to FIG. 14A). After this, the process returns to step S21 in order to, for example, be provided in the subsequent tension adjustment process.

According to the embodiment, it is possible to obtain the effects indicated below.

(1) In a case where it is estimated that the transport belt 51 is made dirty, it is possible to suppress such that dirt on the transport belt 51 does not transfer to the charging roller 81 by moving the charging roller 81 to the roller separation position RRP which is separated from the transport belt 51.

(2) In the jam state in which transport of the paper 14 is delayed, in a case where a probability is high that the transport belt 51 is made dirty by ink due to performing printing by, for example, the recording section 18 discharging ink, it is possible to suppress dirt on the charging roller 81 by detecting the jam state of the paper 14.

(3) The dirt condition of the transport belt 51 is suppressed by keeping the transport belt 51 away from the recording section 18 by moving the transport belt 51 to the retreat position TP using the belt moving section 60. Accordingly, even if the charging roller 81 comes in contact again with the transport belt 51 on which the dirt condition is suppressed, the dirt is suppressed.

(4) In the printer 11, in a state in which the transport belt 51 is mounted to be usable in the casing 12, and printing is not performed, it is possible to suppress strain deformation due to tension of the transport belt 51 since the tension of the transport belt 51 is adjusted to a lower tension than the tension of the transport belt 51 when performing printing on the paper 14.

(5) Since the tension is adjusted by adjusting a direction in which a distance between the two rollers of the driven roller 53 and the driving roller 52 which is bridged by the transport belt 51 is shortened, adjustment work of the tension applied to the transport belt 51 is easy.

(6) Since the tension which is applied to the transport belt 51 is reduced at the retreat position TP where the transport belt 51 is separated from the recording section 18, the transport belt 51 where tension is reduced is suppressed from coming into contact with the recording section 18.

(7) Since the driven roller 53 side is moved such that the distance between rollers is changed with respect to the driving roller 52, it is possible to adjust the tension of the transport belt 51 by easily moving the rollers.

(8) Since the belt moving section 60 moves (swings) the transport belt 51 between the recording position KP and the retreat position TP by rotating the driven roller 53 along a rotation locus where the driving roller 52 is set as the center, it is possible to adjust the tension of the transport belt 51 by, for example, in comparison to parallel movement, easily moving the transport belt 51 to the retreat position TP.

(9) Since the cleaning member 91 is moved between the cleaning member contact position which comes into contact with the belt surface 51*a* of the transport belt 51 and the cleaning member separation position CRP which is separated from the belt surface 51*a* of the transport belt 51, it is possible to improve durability of the transport belt 51 in comparison to a case of coming into normal contact while removing dirt from the transport belt 51.

(10) Since the cleaning member 91 comes into contact with the transport belt 51 in a case where it is estimated that the transport belt 51 is made dirty, it is possible to improve durability of the transport belt 51 in comparison to normal contact while appropriately removing dirt from the transport belt 51.

(11) In the jam state in which transport of the paper 14 is delayed, in a case where a probability is high that the transport belt 51 is made dirty by ink due to performing printing by, for example, the recording section 18 discharging ink, it is possible to appropriately remove dirt from the transport belt 51 by detecting the jam state of the paper 14. In addition, normally, since the cleaning member 91 is suppressed from coming into contact with the transport belt 51, it is possible to improve durability of the transport belt 51.

(12) Since the cleaning member 91 stably comes into contact with the transport belt 51 by supporting the transport belt 51 from the opposite side from the contact side of the cleaning member 91, it is possible to stably remove dirt from the transport belt 51. In addition, since the amount of deflection due to the cleaning member 91 of the transport belt 51 is suppressed using the base section 55*a*, it is possible to improve durability of the transport belt 51.

(13) When recording is not performed on the paper 14 which is moved to the retreat position TP by the transport belt 51, since dirt is removed from the transport belt 51, it is possible to improve durability of the transport belt 51 while removing dirt from the transport belt 51 without printing on the paper 14 by the recording section 18 being interrupted.

Here, the embodiment may be modified to the following other embodiments.

In the embodiment, in a case where ink is discharged other than the case where the recording section 18 performs printing on the paper 14, the charging roller 81 may be positioned at a position which comes into contact with the transport belt 51 (roller contact position RSP).

For example, as shown in FIG. 2, there are cases where the flushing process in which ink is discharged other than in a case where the recording section 18 performs printing on the paper 14 is performed as a maintenance process of the recording section 18 in a state in which the cap 71 is moved so as to be positioned on the gravity direction −Z side with respect to the recording section 18 by the cap movement mechanism 70. In addition, there are cases of a capping process in which the recording section 18 is covered by the cap 71 in order to prevent drying of a portion which discharges ink in the recording section 18, an ink suction process in which bubbles within an ink flow path are suctioned along with ink in the recording section 18 via the cap 71 upon the recording section 18 being covered by the cap 71 in order to suction bubbles within the flow path of the recording section 18, and the like are performed. In such cases, even if ink is discharged toward the cap 71 from the recording section 18, since a probability that discharged ink is adhered within the cap 71 and ink is adhered to the transport belt 51 is low, a possibility that the charging roller 81 is made dirty by being positioned at the roller contact position RSP which comes into contact with the transport belt 51 is low. Of course, in such cases, the cleaning unit 90 is in the state shown in FIG. 12B, that is, a state of being positioned at the cleaning member separation position CRP at which the extending section 96 of the right side wall section 92R and the left side wall section 92L of the base frame 92 does not come into contact with the lever section 82*b* of the bearing member 82.

According to an applied example, the following effects are possible in addition to effects (1) to (13) in the embodiments above.

(14) In a case where the possibility that the transport belt 51 is made dirty by ink which is discharged from the recording section 18 is low, since it is possible to charge the transport belt 51 by moving the charging roller 81 to the roller contact position RSP, it is possible to shorten the time until the paper 14 is transported again by the transport belt 51.

In the embodiment, in a case where the dirt estimation section estimates that the transport belt 51 is made dirty, the charging roller 81 is not necessarily moved to the roller separation position RRP. For example, in a case where recording is not performed by the recording section 18 being a case in which the operation process in which the tension of the transport belt 51 is adjusted is performed, since it is not necessary to adsorb the paper 14 by charging the transport belt 51, the charging roller 81 may be moved to the roller separation position RRP.

According to an applied example, the following effects are possible in addition to effects (1) to (13) in the embodiments above.

(15) In a case where it is not necessary to charge the transport belt 51 such as in a case where the paper 14 is not transported, it is possible to suppress dirt accompanying contact with the transport belt 51 of the charging roller 81 by separating the charging roller 81 from the transport belt 51.

In the embodiments, in a case where the dirt estimation section estimates that the transport belt 51 is made dirty, the charging roller 81 is not necessarily configured to move to the roller separation position RRP which is separated from the transport belt 51 in a state in which the transport belt 51 is moved to the retreat position TP which is separated more from the recording section 18 than the recording position KP. For example, in the state in which the transport belt 51 is positioned at the recording position KP, the charging roller moving section may be configured to move the charging roller 81 to the roller separation position RRP which is separated from the transport belt 51. Of course, in this case, in a state in which the transport belt 51 is positioned at a position which is different from the retreat position TP (for example, the recording position KP), it is preferable that the cleaning unit 90, with a configuration in which the cleaning member 91 comes into contact with the transport belt 51, is provided as the charging roller moving section.

In the embodiments, the cleaning unit 90 does not necessarily function as a charging roller moving section. Here, although description is omitted in the drawings, for example, a movement mechanism which moves the lever section 82*b* of the bearing member 82 so as to press and come into contact in the same manner as the extending section 96 of the base frame 92 in the cleaning unit 90 may be provided as the charging roller moving section. In this manner, by providing the charging roller moving section separately to the cleaning unit 90, it is possible to move the charging roller 81 between the roller contact position RSP and the roller separation position RRP without being in conjunction with the movement of the cleaning unit 90 between the cleaning member separation position CRP and the cleaning member contact position CSP.

In the embodiments, the dirt estimation section does not necessarily estimate that the transport belt 51 is made dirty by detecting the jam state (paper jam) in which transport of the paper 14 by the transport belt 51 is delayed. For example, the dirt estimation section may estimate that the transport belt 51 is made dirty in a case where paper of a smaller size than the size of the paper which is estimated by the printing data is transported. Alternatively, in a case where the flushing process in performed on the belt surface 51*a* by the recording section 18, or in a case where characters of a test pattern for performing correction of discharge defect detection or a discharge method of the recording section 18 is performed on the belt surface 51*a*, it may be estimated that the transport belt 51 is made dirty. That is, in such cases, on the belt surface 51*a* of the transport belt 51, it is possible that the transport belt 51 is made dirty due to ink which is adhered to a portion on which the paper 14 is not adsorbed. Then, it is possible to suppress such that the charging roller 81 is not made dirty by estimating dirt on the transport belt 51 that occurs in such a manner. In addition, it is possible to wipe away the dirt which occurs on the transport belt 51 using the cleaning member 91.

In the embodiments, the belt moving section 60 may not necessarily be configured to move the transport belt 51 between the recording position KP and the retreat position TP by swinging with the roller shaft of the driving roller 52 as the center. For example, the transport belt 51 may be configured to move between the recording position KP and the retreat position TP by parallel movement without moving due to swinging.

Here, in the case of the configuration in which the transport belt 51 moves in parallel, for example, there is a case in which so-called gap adjustment is performed in which the distance between the recording section 18 and the printing surface of the paper 14 which is transported by being adsorbed on the transport belt 51 is adjusted by moving the transport belt 51 in parallel in order to suppress deterioration of printing quality. In such a case, the position of the transport belt 51 is the recording position KP in the state in which the gap adjustment is performed. Then, the retreat position TP of the transport belt 51 is a position which is further separated (spaced apart) from the recording section 18 with respect to the position of the transport belt 51 which is most separated from the recording section 18 in the gap adjustment.

In the embodiments, the two rollers which are bridged by the transport belt 51 are not necessarily set as one roller as the driving roller 52 and the other roller set as the driven roller 53. For example, the two rollers may both be driven rollers or may both be driving rollers.

In the embodiments, the transport belt 51 may be an endless belt which bridges between a plurality of rollers of three or more. Here, in this case, in at least two rollers out of the plurality of rollers, in the embodiment, one roller is set as the driving roller 52 which is a swing center for the transport belt 51, and the other roller is set as the driven roller 53 where the belt surface 51*a*, on which the paper 14 is transported by facing the recording section 18, is formed between the driving roller 52.

In the embodiments, the tension adjustment section 85 is not necessarily limited to only adjusting the tension with respect to the transport belt 51 which is moved to the retreat position TP by the belt moving section 60 to a lower tension than the tension of the transport belt 51 when recording is performed on the paper 14 by the recording section 18. For example, the tension adjustment section 85 may be configured so as to adjust the tension with respect to the transport belt 51 which is positioned at the recording position KP, and may be configured so as to adjust the tension with respect to the transport belt 51 which is positioned between the recording position KP and the retreat position TP.

In the embodiments, the tension adjustment section 85 is not necessarily configured to adjust the tension which is applied to the transport belt 51 by pressing on the base section 55*a* such that the expansion and contraction section 55*b* of the belt frame body 55 is contracted by the slider 88. For example, there may be a configuration in which tension that is applied to the transport belt 51 is adjusted by changing biasing force of the biasing member which biases the expansion and contraction section 55*b* in the direction of protrusion from the base section 55*a*.

In the embodiments, there may be a configuration in which tension is applied to the transport belt 51 when the recording section 18 performs printing (recording) on the paper 14 by biasing such that the distance between the driven roller 53 and the driving roller 52 is lengthened. For example, tension which is applied to the transport belt 51 is adjusted by changing the distance between the driven roller 53 and the driving roller 52 without biasing using the biasing member and changing the distance to the driving roller 52 by moving the position of the driven roller 53 with respect to the driving roller 52.

In the embodiments, the cleaning member moving section does not necessarily move the cleaning member 91 between the cleaning member contact position CSP which is in contact with the belt surface 51*a* and the cleaning member separation position CRP which is separated from the belt surface 51*a* with respect to the transport belt 51 which is moved to the retreat position TP by the belt moving section 60. Here, although description is omitted by the drawings, for example, the cleaning member moving section with a configuration in which the cleaning member 91 comes into contact with the transport belt 51 may be provided in a state in which the transport belt 51 is positioned at the recording position KP. Alternatively, the cleaning member moving section with a configuration in which the cleaning member 91 comes into contact with the transport belt 51 may be provided at an arbitrary position between the recording position KP and the retreat position TP.

In the embodiments, the belt moving section is not necessarily provided which supports at least a portion of the belt contact section BS of the transport belt 51 to which the cleaning member 91 that is moved to the cleaning member contact position CSP comes into contact. For example, in the state in which the transport belt 51 is stretched, in a case where it is possible to stably support a portion of the belt contact portion BS using the belt surface 51*a* onto which tension is applied, it is not necessary to provide the belt support section on the belt frame body 55 and the like.

In the embodiment, in a case where the dirt estimation section estimates that the transport belt 51 is made dirty, the cleaning member 91 is not necessarily moved to the cleaning member contact position CSP. For example, in a case of the flushing process which discharges ink other than the case in which the recording section 18 performs recording on the paper 14 or a case in which a capping process or the like in which the recording section 18 covers the cap 71 in order to maintain the ink discharge performance does not perform recording using the recording section 18, the cleaning member 91 may be moved to the cleaning member contact position CSP.

In the embodiment, the recording section 18 is not limited to a configuration of a so-called line head which is provided with a liquid discharge head that is able to simultaneously discharge ink across substantially the whole region of the paper 14 in the width direction X. For example, the recording section 18 may have a configuration of a so-called serial head which is provided with a liquid discharge head that discharges ink in a carriage that reciprocally moves in the width direction X which intersects with the transport direction of the paper 14. Here, the case of the configuration of the serial head is a configuration in which the longitudinal direction of the recording section 18 is a movement direction of the carriage, and the transported paper 14 is intermittently transported in the transport direction Y.

In the embodiment, a supply source of the ink which is recording liquid that is discharged from the recording section 18 may be an ink accommodating body which is, for example, provided inside the casing 12 of the printer 11. Alternatively, the supply source may be an ink accommodating body of a so-called external type which is provided externally to the casing 12. In particular, in the case of the external type ink accommodating body, since it is possible to increase the ink capacity, it is possible to perform discharge of a greater amount of ink than from the recording section 18.

Here, in a case where ink is supplied from the ink accommodating body which is provided externally to the casing 12 to the recording section 18, it is necessary to route an ink supply tube for supplying ink from the outside to the inside of the casing 12. Consequently, in this case, it is preferable to provide a hole, a cutout notch, and the like into which it is possible to insert the ink supply tube in the casing 12. Alternatively, a gap is provided in the casing 12, and the ink supply tube may be routed from the outside to the inside of the casing 12 through the gap. By doing this, it is possible to easily perform ink supply with respect to the recording section 18 using an ink flow path of the ink supply tube.

In the embodiment, the printer 11 as a recording apparatus may be a fluid body discharge apparatus which performs recording by discharging or ejecting a fluid body other than ink (including a liquid, a liquid form body in which a particulate functional material is dispersed or mixed in a liquid, a fluid form body such as gel, and a solid body which is able to be discharged by flowing as a fluid body). For example, the apparatus may be a liquid form body discharge apparatus which performs printing by discharging a liquid form body including, in a dispersed or dissolved form, material such as an electrode material or color material (pixel material) which are used in manufacture and the like of a liquid crystal display, an electro-luminescence (EL) display, and a surface light emission display. In addition, the apparatus may be a fluid form body discharge apparatus which discharges a fluid form body such as gel (for example, physical gel), or a powder and granular body discharge apparatus (for example, a toner jet type printing apparatus) which discharges a solid body as an example of a powder (powder and granular body) such as toner. Then, it is possible to apply the invention to a fluid body discharge apparatus of at least one of the types. Here, in the specification "fluid body" is a concept which does not include a fluid body which comprises only gas, and for example, liquid (including an inorganic solvent, an organic solvent, a solution, a liquid resin, a liquid metal (molten metal), and the like), a liquid form body, a fluid form body, a powder and granular body (including a granular body and powder body), and the like are included in fluid body.

The entire disclosure of Japanese Patent Application No. 2015-066982, filed Mar. 27, 2015 is expressly incorporated by reference herein.

What is claimed is:

1. A recording apparatus comprising:

a recording section which performs recording by discharging liquid on a recording medium;

a transport belt which is able to transport the recording medium by rotating;

a charging roller which charges the transport belt;

a charging roller moving section which moves the charging roller between a charging roller contact position that is a position at which the charging roller is brought into contact with the transport belt and a charging roller separation position which is a position that is separated from the transport belt more than the charging roller contact position;

a cleaning member which removes dirt from a belt surface of the transport belt by coming into contact with the belt surface;

a cleaning member moving section which moves the cleaning member between a cleaning member contact position at which the cleaning member is brought into contact with the belt surface of the transport belt and a cleaning member separation position at which the cleaning member is separated from the belt surface of the transport belt, and a dirt estimation section which estimates dirt on the transport belt, wherein the charging roller moving section moves the charging roller from the charging roller contact position to the charging roller separation position in a case where the dirt estimation section estimates that the transport belt is dirty, and wherein the charging roller is configured to move from the charging roller contact position to the charging roller separation position according to movement of the cleaning member from the cleaning member separation position to the cleaning member contact position.

2. The recording apparatus according to claim 1, wherein the dirt estimation section estimates that the transport belt is dirty when detecting a jam state in which transport of the recording medium by the transport belt is delayed.

3. The recording apparatus according to claim 1, wherein the transport belt is stretched between a driving roller and a driven roller, and the recording apparatus further comprises a belt moving section which moves the transport belt to a second position that is further separated from the recording section than a first position at which the recording section performs recording by swinging the transport belt about a roller shaft of the driving roller in a case where the dirt estimation section estimates that the transport belt is dirty.

4. The recording apparatus according to claim 1, further comprising:

a cap which is able to cover at least a portion of the recording section from which the liquid is discharged, using a closed space, wherein the charging roller is positioned at the charging roller contact position at which the charging roller comes into contact with the transport belt in a case where the liquid is discharged toward the cap from the recording section.

5. The recording apparatus according to claim 1, wherein:

the cleaning member moving section moves the cleaning member from the cleaning member separation position to the cleaning member contact position in a case where the dirt estimation section estimates that the transport belt is dirty.

6. The recording apparatus according to claim 1, further comprising:

a bearing member, on one end side of which a bearing section is formed that receives a shaft of the charging roller and on the other end side of which a lever section is formed, and which is axially supported so as to freely rotate between the bearing section and the lever section; and a cleaning unit which has the cleaning member, wherein the charging roller is moved from the charging roller contact position to the charging roller separation position by a portion of the cleaning unit which abuts with the lever section pressing the lever section with the cleaning member moving from the cleaning member separation position to the cleaning member contact position.

* * * * *